US010814619B2

(12) United States Patent
Morikawa et al.

(10) Patent No.: US 10,814,619 B2
(45) Date of Patent: Oct. 27, 2020

(54) IMAGE PROCESSING DEVICE AND NON-TRANSITORY COMPUTER-READABLE MEDIUM

(71) Applicant: Brother Kogyo Kabushiki Kaisha, Nagoya-shi, Aichi-ken (JP)

(72) Inventors: Shota Morikawa, Nagoya (JP); Masashi Kuno, Obu (JP); Satoru Arakane, Nagoya (JP); Yoshiharu Furuhata, Nagoya (JP); Shin Hasegawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/570,652

(22) Filed: Sep. 13, 2019

(65) Prior Publication Data

US 2020/0086639 A1 Mar. 19, 2020

(30) Foreign Application Priority Data

Sep. 15, 2018 (JP) ..... 2018-173135

(51) Int. Cl.
*B41J 2/045* (2006.01)
*B41J 2/155* (2006.01)

(52) U.S. Cl.
CPC ..... *B41J 2/04543* (2013.01); *B41J 2/04563* (2013.01); *B41J 2/04573* (2013.01); *B41J 2/155* (2013.01)

(58) Field of Classification Search
CPC .... B41J 2/04543; B41J 2/155; B41J 2/04573; B41J 2/04563; B41J 2/2128; B41J 2/2132
See application file for complete search history.

(56) References Cited

U.S. PATENT DOCUMENTS 5,610,637 A * 3/1997 Sekiya ..... B41J 2/04551 347/10
6,042,219 A * 3/2000 Higashino ..... B41J 2/14274 347/15
6,375,309 B1 * 4/2002 Taneya ..... B41J 2/04533 347/48

FOREIGN PATENT DOCUMENTS

JP 2004-066550 A 3/2004

* cited by examiner

*Primary Examiner* — Henok D Legesse
(74) *Attorney, Agent, or Firm* — Banner & Witcoff, Ltd.

(57) ABSTRACT

An image processing device configured to: determine whether a specific condition indicating ink supplied from an ink supplier to a printing head may be delayed; generate dot data by using image data, including: generating first dot data when the specific condition is not satisfied; and generating second dot data when the specific condition is satisfied, a ratio of first/second type of dots included in an image based on specific second dot data generated using specific image data being greater/smaller than that included in an image based on specific first dot data generated using the specific image data, and total number of dots included in the image based on the specific second dot data being larger that included in the image based on the specific first dot data; and output printing data based on the dot data.

11 Claims, 13 Drawing Sheets

FIG. 6A

DETERMINATION THRESHOLD VALUE TABLE TT

| | | HEAD TEMPERATURE | | |
|---|---|---|---|---|
| | | LOW | MEDIUM | HIGH |
| CUMULATIVE-USED AMOUNT OF INK | SMALL | 70% | 85% | 100% |
| | MEDIUM | 65% | 80% | 100% |
| | LARGE | 60% | 75% | 100% |

FIG. 6B

THRESHOLD VALUE TABLE HT OF HALFTONE PROCESSING

| | | DEFAULT | DIFFERENCE ΔV | | |
|---|---|---|---|---|---|
| | | | ~5% | 5%~15% | 15%~ |
| DOT SIZE | EXTRA-LARGE | Tbb0 | TbbB | NO DOT | NO DOT |
| | LARGE | Tb0 | TbS | Tb0 | NO DOT |
| | MEDIUM | Tm0 | Tm0 | TmS | TmS |
| | SMALL | Ts0 | Ts0 | Ts0 | TsS |

FIG. 9

REPLACEMENT RATIO SETTING TABLE RT

| | DIFFERENCE ΔVm | | |
|---|---|---|---|
| | ~5% | 5%~15% | 15%~ |
| REPLACEMENT RATIO | 50% | 75% | 100% |

IMAGE PROCESSING DEVICE AND NON-TRANSITORY COMPUTER-READABLE MEDIUM

CROSS-REFERENCE TO RELATED APPLICATIONS

This application claims priority from Japanese patent application No. 2018-173135 filed on Sep. 15, 2018, the entire subject-matter of which is incorporated herein by reference.

TECHNICAL FIELD

The present disclosure relates to image processing for a printing execution device configured to form a plurality of types of dots on a printing medium.

BACKGROUND

A printer configured to print an image by ejecting ink from nozzles of a printing head has been known. In the related-art printer, for example, when a temperature of the ink is relatively low, a viscosity of the ink is increased, so that delay in ink supply from an accommodation part of the ink to the printing head is likely to occur. When the delay in ink supply occurs, an image quality is deteriorated due to thinning of a printed image, for example.

There has been proposed a related-art technology of increasing the number of passes to print the band when the number of continuous ejections of dots counted in a band is larger than a threshold value corresponding to a temperature of the printing head.

SUMMARY

Illustrative aspects of the disclosure provide technology capable of suppressing delay in ink supply and suppressing a situation where a printing speed is lowered owing to the suppressing of delay in ink supply.

According to one illustrative aspect, there may be provided an image processing device for a printing execution device, the printing execution device comprising: a printing head having a plurality of nozzles configured to eject ink; an ink supplier configured to supply the ink to the printing head; and a first scanning device configured to execute a first scanning of moving a printing medium relative to the printing head in a first direction, the printing head being configured to form on the printing medium a plurality of types of dots comprising a first type of dot and a second type of dot, the second type of dot being larger than the first type of dot, the image processing device being configured to: determine whether a specific condition is satisfied, the specific condition indicating that the ink supply from the ink supplier to the printing head may be delayed; generate dot data by using image data, the dot data indicating a formation state of a dot for each pixel, the generating comprising: in a case the specific condition is not satisfied, generating first dot data by executing first generation processing; and in a case the specific condition is satisfied, generating second dot data by executing second generation processing, a ratio of the first type of dots included in an image based on specific second dot data generated by using specific image data being greater than a ratio of the first type of dots included in an image based on specific first dot data generated by using the specific image data, a ratio of the second type of dots included in the image based on the specific second dot data being smaller than a ratio of the second type of dots included in the image based on the specific first dot data, and total number of dots included in the image based on the specific second dot data being larger than total number of dots included in the image based on the specific first dot data; and output, to the printing execution device, printing data based on the dot data.

In a case expressing the same density, in general, the smaller the dots are used, the smaller the used amount of ink is. According to the above configuration, in the image to be printed, when the specific condition, which indicates that the ink supply from the ink supplier to the printing head may be delayed, is satisfied, the ratio of the first type of dots is increased and the ratio of the second type of dots larger than the first type of dots is decreased, as compared to a case where the specific condition is not satisfied. As a result, when the ink supply from the ink supplier to the printing head may be delayed, it is possible to suppress the delay in ink supply in order that the used amount of the ink is suppressed. Also, since it is possible to suppress the delay in ink supply simply by changing the type of dots to be used, it is possible to suppress a situation where a printing speed is lowered so as to suppress the delay in ink supply.

The technology of the present disclosure may be performed in a variety of forms, such as a printing apparatus, a control method of the printing execution device, a printing method, a non-transitory computer-readable medium for performing functions of the apparatus and method, a recording medium having the non-transitory computer-readable medium recorded therein, and the like.

BRIEF DESCRIPTION OF DRAWINGS

Illustrative aspects of the invention will be described in detail with reference to the following figures wherein:

FIGS. 6A and 6B depict examples of tables included in a control table group TG (FIG. 1);

FIG. 9 depicts an example of a replacement ratio setting table RT; and

DETAILED DESCRIPTION

In the above-described related-art technology, a printing speed may be lowered in order that the number of passes to print the band is increased.

Therefore, illustrative aspects of the disclosure provide technology capable of suppressing delay in ink supply and suppressing a situation where a printing speed is lowered owing to the suppressing of delay in ink supply.

Hereinafter, illustrative embodiments of the disclosure will be described.

A. First Illustrative Embodiment

A-1: Configuration of Printer 200

Figure 1:
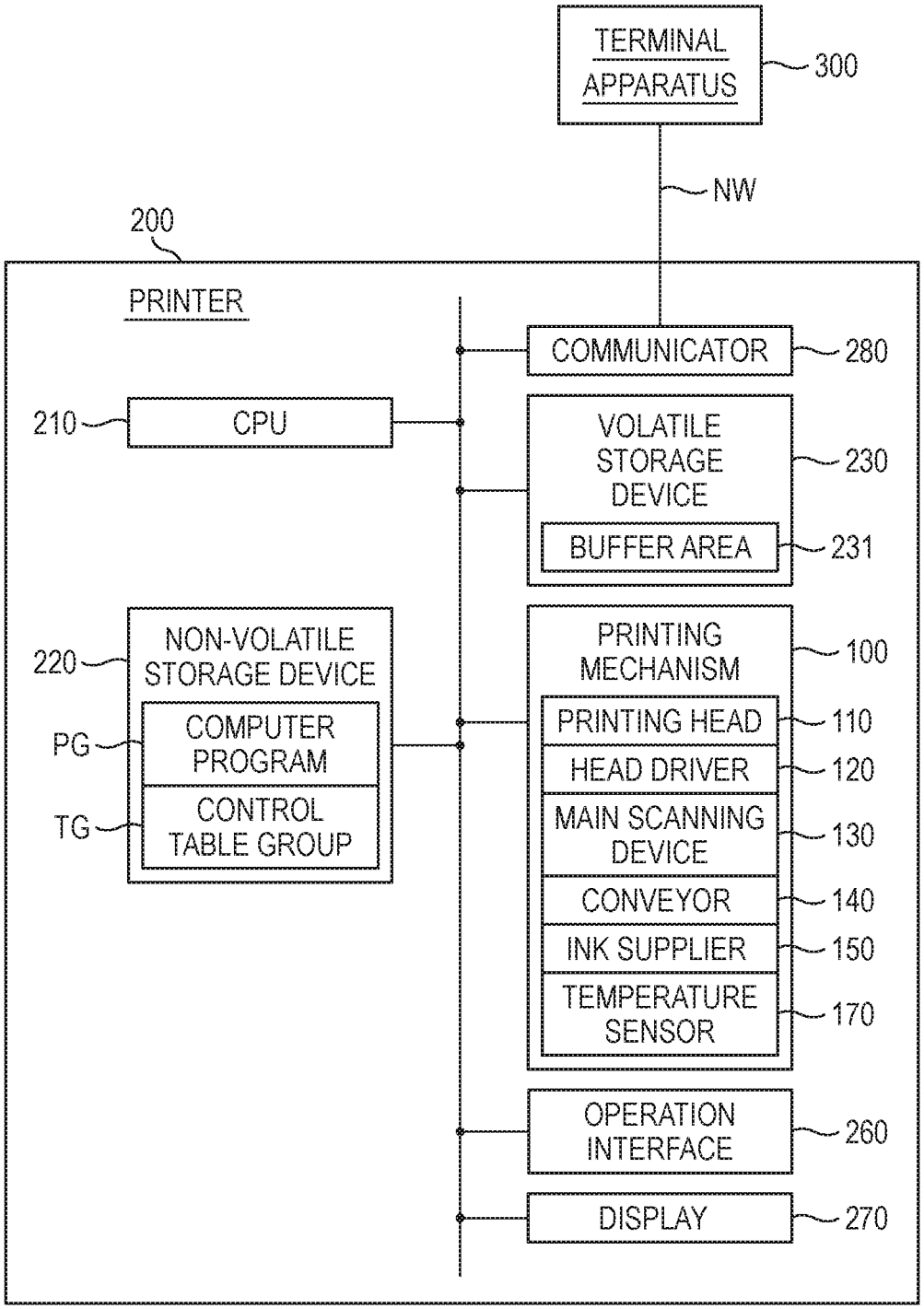
FIG. 1 is a block diagram depicting a configuration of a printer 200 of an illustrative embodiment.

Hereinafter, an illustrative embodiment will be described. FIG. 1 is a block diagram depicting a configuration of a printer 200 of an illustrative embodiment.

The printer 200 includes, for example, a printing mechanism 100, a CPU 210 as a controller of the printer 200, a non-volatile storage device 220 such as a hard disk drive, a volatile storage device 230 such as a RAM, an operation interface 260 such as buttons and a touch panel for obtaining a user's operation, a display 270 such as a liquid crystal monitor, and a communicator 280. The communicator 280 includes a wired or wireless interface for connecting to a network NW. The printer 200 is communicatively connected to an external apparatus, for example, a terminal apparatus 300 via the communicator 280.

The volatile storage device 230 provides a buffer area 231 for temporarily storing therein a variety of intermediate data that are generated when the CPU 210 performs processing. In the non-volatile storage device 220, a computer program PG and a control table group TG are stored. In the first illustrative embodiment, the computer program PG is a control program for controlling the printer 200. The computer program PG and the control table group TG may be provided while being stored in the non-volatile storage device 220 upon shipment of the printer 200. Instead of this configuration, the computer program PG and the control table group TG may be downloaded from a server or may be provided while being stored in a DVD-ROM and the like. The CPU 210 is configured to execute the computer program PG, thereby executing image processing to be described later, for example. Thereby, the CPU 210 controls the printing mechanism 100 to print an image on a printing medium (for example, a sheet). The control table group TG is a table for determining a parameter to be used in the image processing. The control table group TG will be described later.

The printing mechanism 100 is configured to form dots on a sheet M by using inks (ink droplets) of cyan (C), magenta (M), yellow (Y) and black (K), thereby performing color printing. The printing mechanism 100 includes a printing head 110, a head driver 120, a main scanning device 130, a conveyor 140, an ink supplier 150 and a temperature sensor 170.

Figure 2:
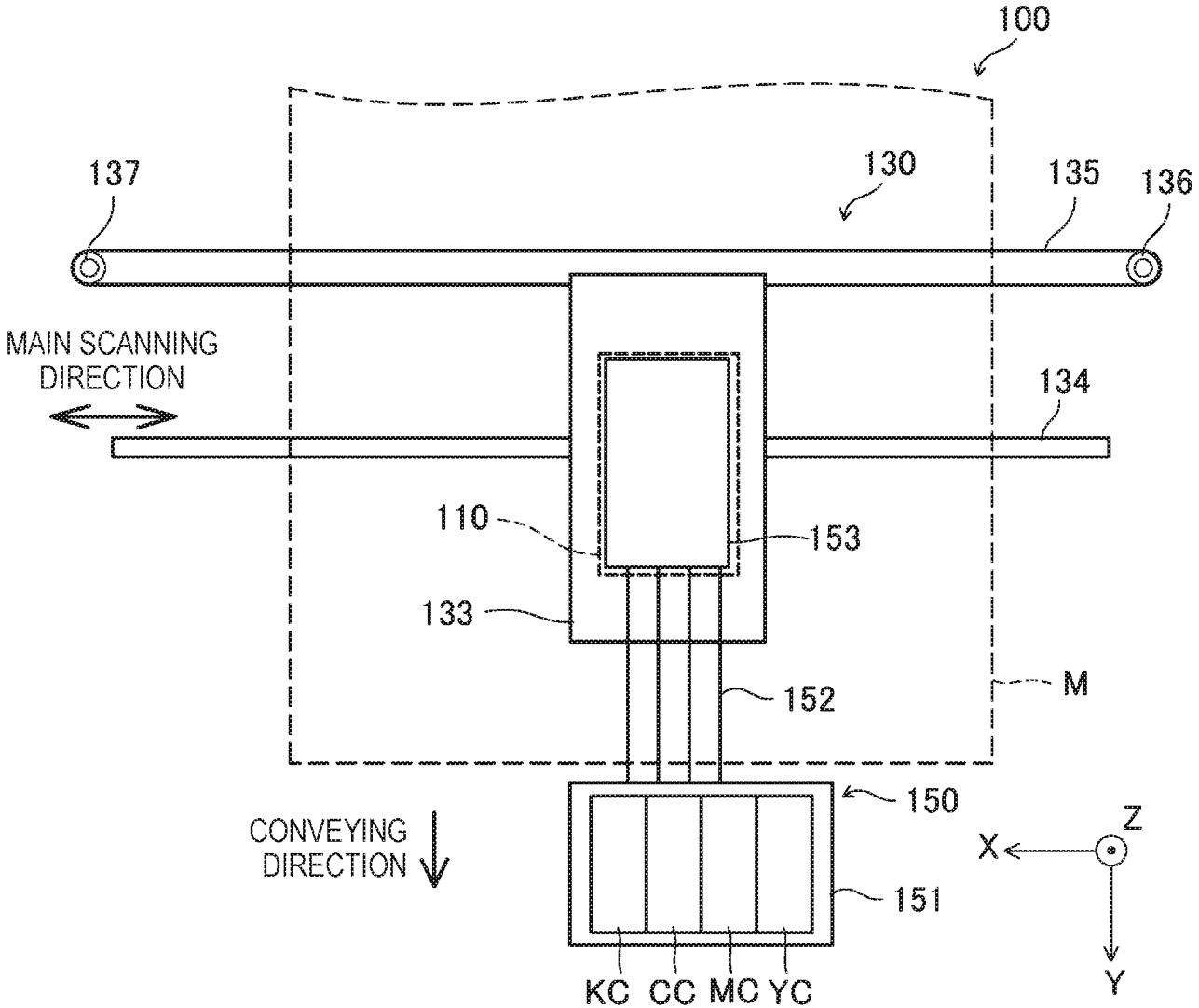
FIG. 2 depicts a schematic configuration of a printing mechanism 100.

FIG. 2 depicts a schematic configuration of the printing mechanism 100. As shown in FIG. 2, the main scanning device 130 includes a carriage 133, a slide shaft 134, a belt 135, and a plurality of pulleys 136, 137. The carriage 133 is configured to mount thereon the printing head 110. The slide shaft 134 is configured to hold the carriage 133 to be reciprocally moveable in a main scanning direction (X-axis direction, in FIG. 2). The belt 135 is wound on the pulleys 136, 137, and a part thereof is fixed to the carriage 133. The pulley 136 is rotated by power of a main scanning motor (not shown). When the main scanning motor rotates the pulley 136, the carriage 133 moves along the slide shaft 134. Thereby, a main scanning of reciprocally moving the printing head 110 relative to the sheet M in the main scanning direction is performed.

The conveyor 140 is configured to convey the sheet M in a conveying direction (+Y direction, in FIG. 2) while holding the sheet M. Hereinafter, an upstream side (−Y side) in the conveying direction is simply referred to as 'upstream side', and a downstream side (+Y side) in the conveying direction is simply referred to as 'downstream side'. Although not specifically shown, the conveyor 140 includes a pair of upstream rollers configured to hold the sheet M on a further upstream side than the printing head 110, a pair of downstream rollers configured to hold the sheet M on a further downstream side than the printing head 110, and a motor. The conveyor 140 is configured to convey the sheet M by driving the rollers with power of the motor.

The ink supplier 150 is configured to supply ink to the printing head 110. The ink supplier 150 includes a cartridge mounter 151, tubes 152, and a buffer tank 153. A plurality of ink cartridges KC, CC, MC, YC in which inks are accommodated is detachably mounted to the cartridge mounter 151, and the inks are supplied from the ink cartridges. The buffer tank 153 is arranged above the printing head 110 mounted to the carriage 133, and is configured to temporarily accommodate therein each ink of CMYK to be supplied to the printing head 110. The tube 152 is a flexible tube configured to interconnect the cartridge mounter 151 and the buffer tank 153 and becoming a flow path of the ink. The ink in each ink cartridge is supplied to the printing head 110 through the cartridge mounter 151, the tube 152 and the buffer tank 153. The buffer tank 153 is provided with a filter (not shown) for removing foreign matters mixed in the ink.

Figure 3:
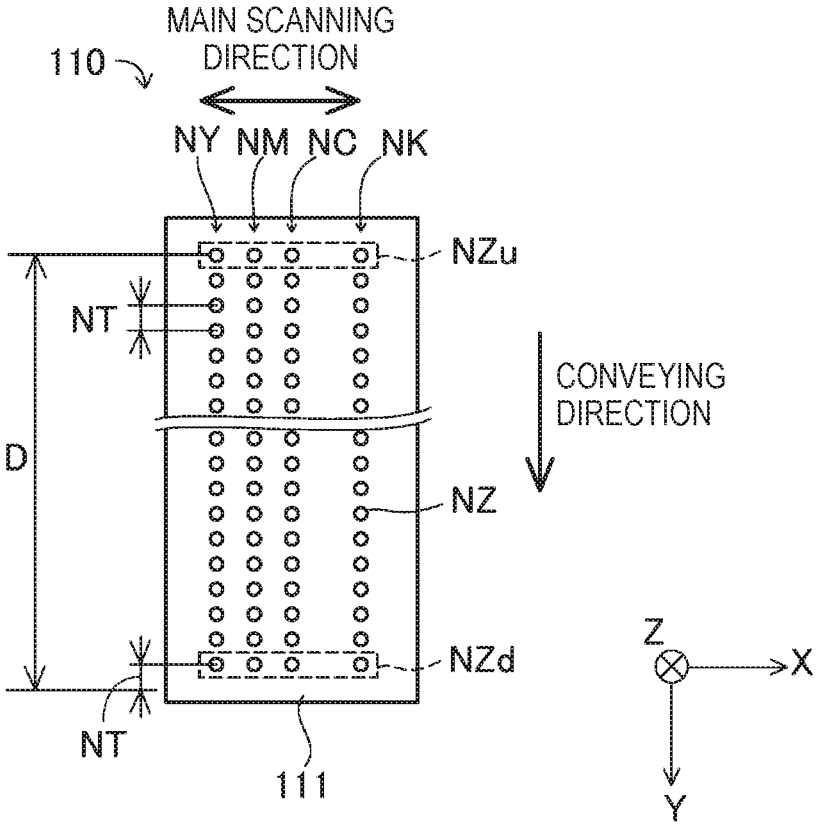
FIG. 3 depicts a configuration of a printing head 110, as seen from −Z side.

FIG. 3 depicts a configuration of the printing head 110, as seen from −Z side. As shown in FIG. 3, a nozzle formation surface 111 of the printing head 110 is a surface facing the sheet M to be conveyed by the conveyor 140. The nozzle formation surface 111 is formed with a plurality of nozzle rows consisting of a plurality of nozzles NZ, i.e., nozzle rows NC, NM, NY, NK for ejecting the respective inks of C, M, Y and K. Each nozzle row includes a plurality of nozzles NZ. The plurality of nozzles NZ has positions different from each other in the conveying direction (+Y direction), and is aligned with predetermined nozzle intervals NT in the conveying direction. The nozzle interval NT is a length in the conveying direction between two nozzles NZ, which are adjacent to each other in the conveying direction, of the plurality of nozzles NZ. A nozzle NZ, which is located on the most upstream side (−Y side), of the nozzles configuring the nozzle row is referred to as the most upstream nozzle NZu. Also, a nozzle NZ, which is located on the most downstream side (+Y side), of the nozzles is referred to as the most downstream nozzle NZd. A length obtained by adding the nozzle interval NT to a length in the conveying direction from the most upstream nozzle NZu to the most downstream nozzle NZd is referred to as 'nozzle length D'.

Positions of the nozzle rows NC, NM, NY, NK in the main scanning direction are different, and positions thereof in a sub-scanning direction overlap each other. For example, in the example of FIG. 3, the nozzle row NM is arranged in the +X direction of the nozzle row NY for ejecting the yellow (Y) ink.

Each nozzle NZ is connected to the buffer tank 153 through an ink flow path (not shown) formed in the printing head 110. Actuators (not shown, piezoelectric elements, in the first illustrative embodiment) for ejecting the inks along the respective ink flow paths in the printing head 110 are provided.

The head driver 120 (FIG. 1) is configured to drive each actuator in the printing head 110, in accordance with printing data to be supplied from the CPU 210 during the main scanning by the main scanning device 130. Thereby, the inks are ejected from the nozzles NZ of the printing head 110 onto the sheet M being conveyed by the conveyor 140, so that dots are formed. The configuration of the head driver 120 will be described later. The head driver 120 is configured to form a plurality of sizes of dots on the sheet M by changing a drive voltage to be supplied to the actuators.

Specifically, the head driver 120 is configured to form four types of dots "small", "medium", "large" and "extra-large" in ascending order.

The temperature sensor 170 is a well-known temperature sensor including a temperature measurement resistance member and the like, and is provided in the vicinity of the printing head 110 of the printer 200. The temperature sensor 170 is configured to output a signal indicative of a temperature of the printing head 110 of the printer 200.

A-2. Outline of Printing

The CPU 210 is configured to print a printed image on the sheet M by alternately executing more than once partial printing of causing the printing head 110 to eject the inks to form dots on the sheet M while causing the main scanning device 130 to perform the main scanning, and a sub-scanning (conveyance of the sheet M) by the conveyor 140.

Figure 4:
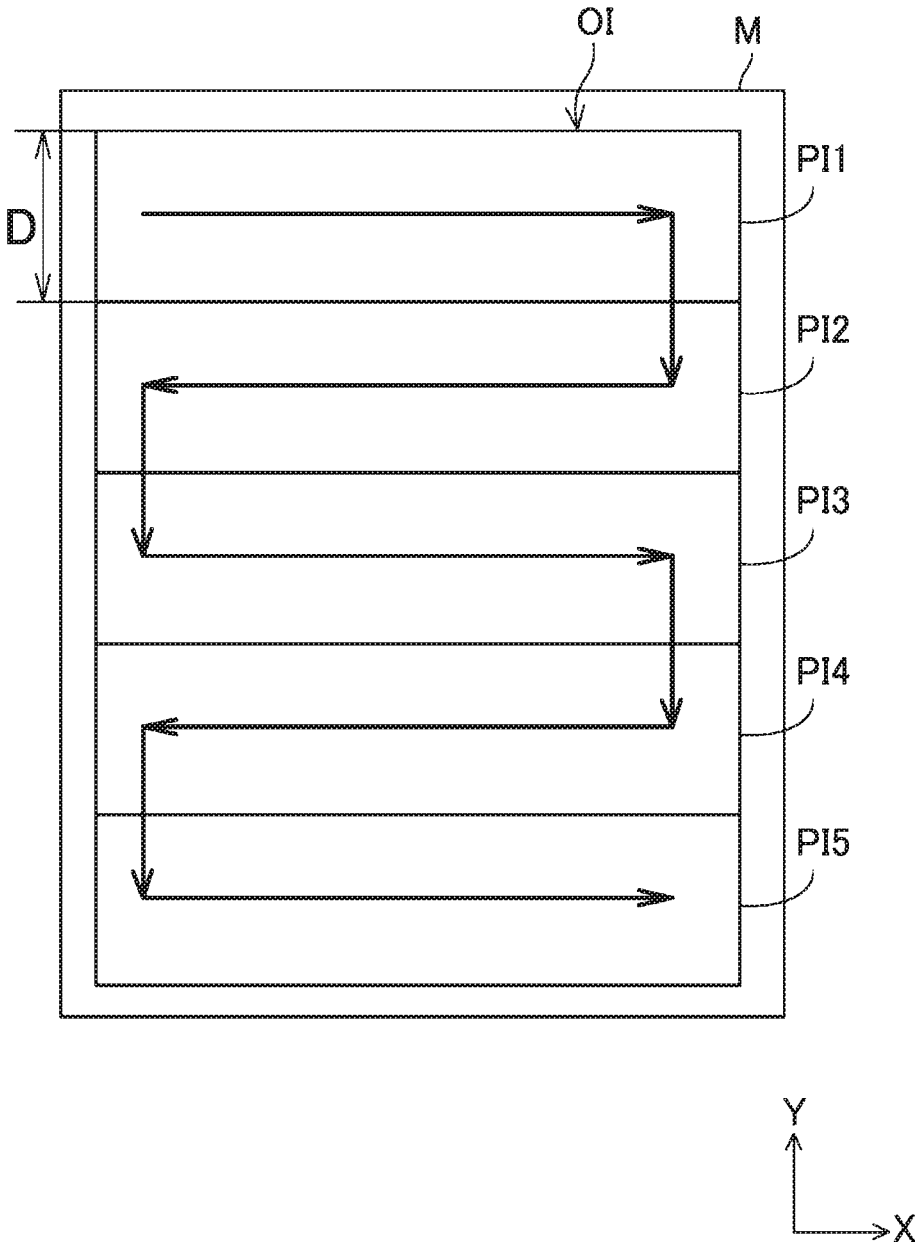
FIG. 4 illustrates operations of the printing mechanism 100.

FIG. 4 illustrates operations of the printing mechanism 100. In FIG. 4, a print image OI to be printed on the sheet M is shown. The printed image OI includes a plurality of partial images PI1 to PI5. Each partial image is an image to be printed by single partial printing. A printing direction of the partial printing is one of a forward direction and a backward direction. That is, the partial printing is one of forward printing of forming dots while performing the main scanning in the forward direction (+X direction in FIG. 4) and backward printing of forming dots while performing the main scanning in the backward direction (−X direction in FIG. 4). In the partial image of FIG. 4, the solid line arrow in the +X direction or the −X direction is shown. The partial images PI1, PI3, PI5 denoted with the solid line arrow in the +X direction are forward partial images to be printed by the forward printing. The partial images PI2, PI4 denoted with the solid line arrow in the −X direction are backward partial images to be printed by the backward printing.

As shown in FIG. 4, the printing of the first illustrative embodiment is bidirectional printing in which the forward printing and the backward printing are alternately executed. The bidirectional printing can shorten printing time, as compared to unidirectional printing in which only the forward printing is repeatedly executed, for example. In the unidirectional printing, since the forward printing is again executed after the forward printing, it is necessary to move the printing head 110 in the backward direction without executing the partial printing. However, it is not necessary to perform such operation in the bidirectional printing.

In FIG. 4, the arrow in the −Y direction facing from one partial image (for example, the partial image PI1) toward another partial image (for example, the partial image PI2) adjacent thereto in the −Y direction corresponds to the conveyance (the sub-scanning) of the sheet M. That is, in FIG. 4, the arrow in the −Y direction indicates that the sheet M is conveyed and the printing head 110 is thus moved relative to the sheet M shown in FIG. 4 in the −Y direction. As shown in FIG. 4, the printing of the first illustrative embodiment is so-called one pass printing, and a length of each partial image in the conveying direction and a single conveying amount of the sheet M are the nozzle length D.

Here, when the ink is ejected from the nozzles NZ during the printing, the ink in the buffer tank 153 (FIG. 2) is reduced by an ejected amount of the ink, so that a negative pressure is generated in the buffer tank 153. By the negative pressure, the ink is supplied from the ink cartridge to the buffer tank 153 through the cartridge mounter 151 and the tube 152. When a large amount of ink is ejected from the plurality of nozzles NZ in a short time for printing, the ink supply to the buffer tank 153 may be delayed. When the delay in ink supply occurs, even though the actuator is actuated, a malfunction that the ink is not ejected from the nozzles NZ or a malfunction that a smaller amount of ink than expected is ejected occurs. When such malfunction occurs, a color is thinned and an image quality is thus degraded in the printed image OI.

The delay in ink supply is likely to occur when flowability of the ink is lowered. For example, the lower a temperature (hereinafter, also referred to as 'head temperature Th') of the printing head 110 of the printer 200 (the printing mechanism 100) is, the more the delay in ink supply is likely to occur. The reason is that as the head temperature Th is lowered, a viscosity of the ink is increased, resulting in a decrease in flowability of the ink. Here, a cumulative-used amount TA of ink is an index value indicative of a cumulative used amount of specific ink (any one of C, M, Y and K) up to now since the manufacturing of the printer 200. The larger the cumulative-used amount TA of ink is, the more the delay of specific ink supply is likely to occur. The reason is that as the cumulative-used amount TA of ink increases, an accumulation amount of foreign matters in a filter for removing the foreign matters in the ink increases, resulting in an increase in flow path resistance of the ink and a decrease in flowability of the ink. Also, a pass-used amount PA of ink is an index value indicative of a used amount of the specific ink to be used for partial image printing in the single partial printing. The larger the pass-used amount PA of ink is, the more the delay of specific ink supply is likely to occur. The reason is that since the specific ink is used in a short time, the specific ink supply cannot keep up with the used amount. In image processing to be described later, a scheme for suppressing the delay in ink supply is made.

A-3. Image Processing

Figure 5A:
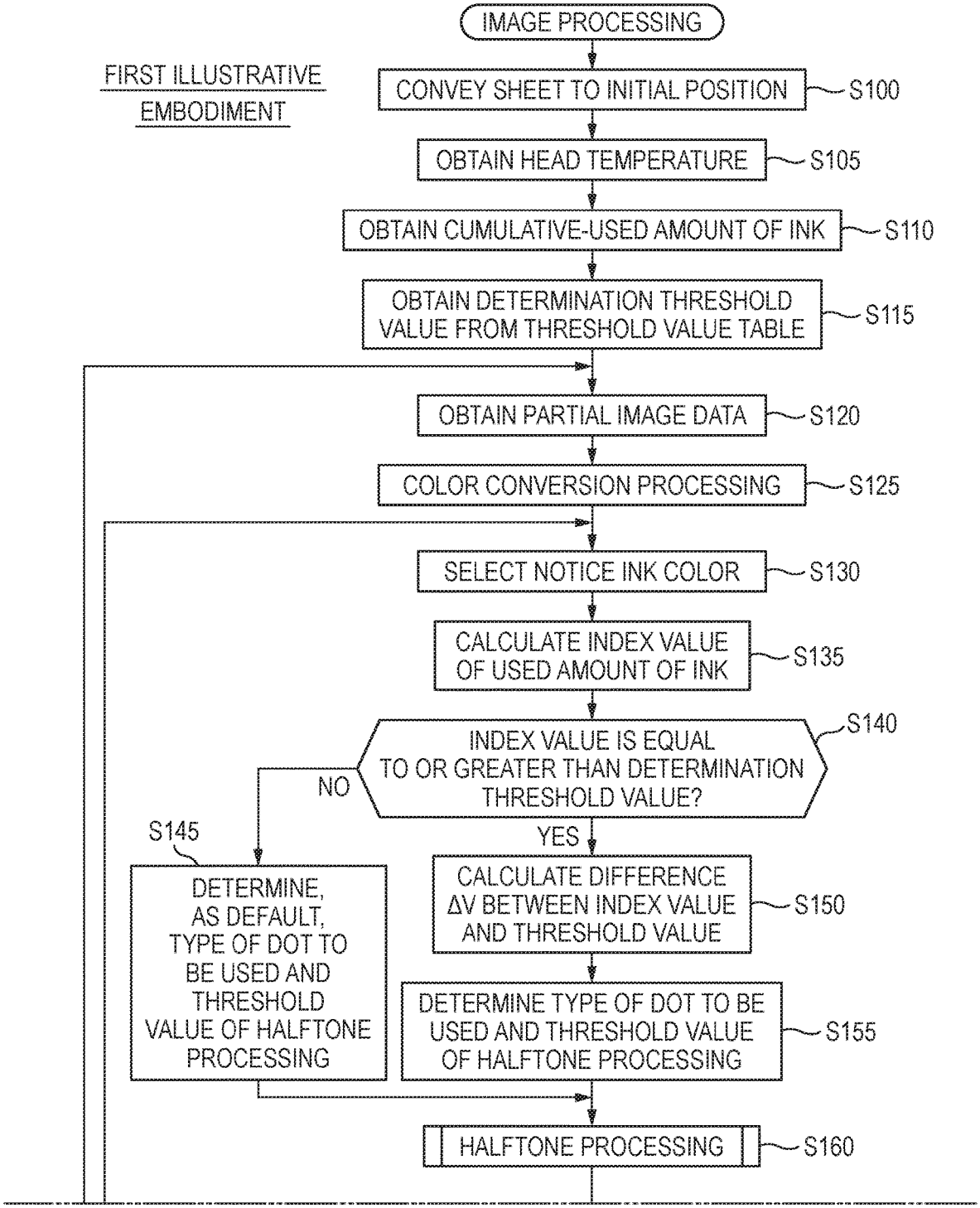
FIGS. 5A and 5B illustrate a flowchart of image processing of a first illustrative embodiment.
Figure 5B:
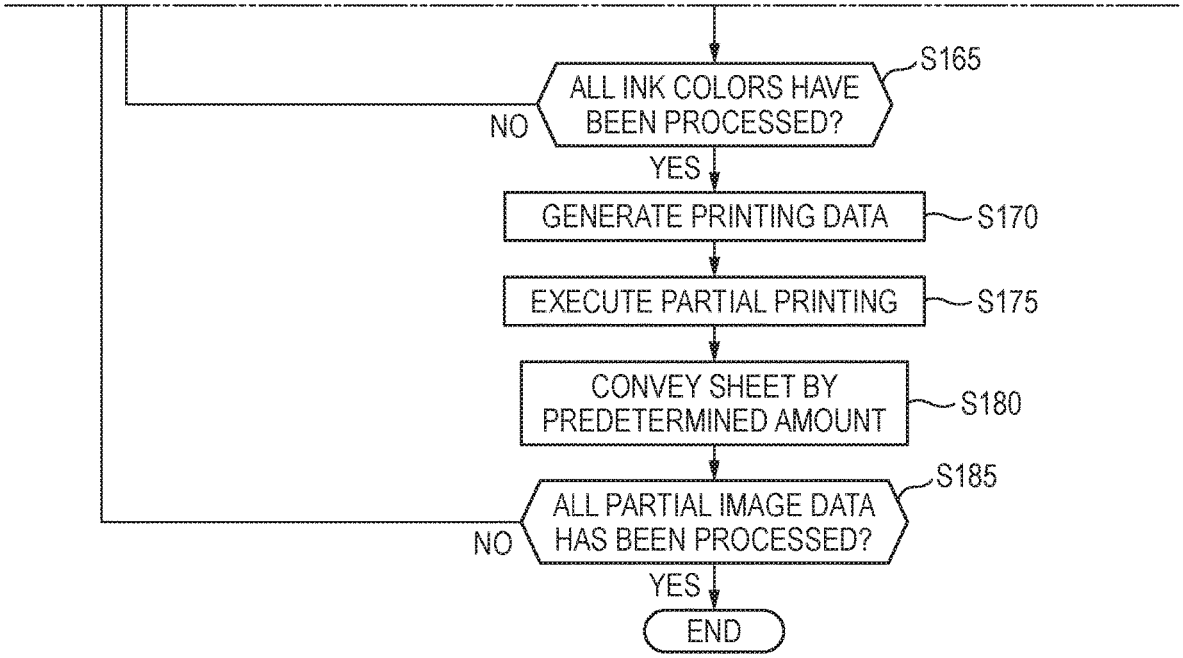

FIGS. 5A and 5B illustrate a flowchart of image processing of the first illustrative embodiment. FIG. 6 depicts an example of a table included in the control table group TG (FIG. 1). When the CPU 210 of the printer 200 receives a printing instruction from the terminal apparatus 300 (FIG. 1), for example, the CPU 210 starts the image processing. Instead of this configuration, the CPU 210 may start the image processing when a printing instruction is obtained from a user through the operation interface 260. The printing instruction includes a designation of image data indicative of an image to be printed.

In S100, the CPU 210 controls the conveyor 140 to convey one sheet M from a print tray (not shown) to a predetermined initial position.

In S105, the CPU 210 obtains the head temperature Th of the printing head 110 of the printer 200, based on a signal from the temperature sensor 170.

In S110, the CPU 210 obtains the cumulative-used amount TA of each ink to be used for printing from the non-volatile storage device 220. The cumulative-used amount TA of ink is recorded for each ink of CMYK in a predetermined area of the non-volatile storage device 220. The CPU 210 calculates a used amount of ink of each color based on the number of dots formed by the printing and updates the cumulative-used amount TA of ink whenever executing the printing, for example. In S110, for example, in the case of monochrome printing, the cumulative-used amount TA of black (K) ink is obtained, and in the case of color printing, the cumulative-used amount TA of each ink of CMYK is obtained.

In S115, the CPU 210 obtains, based on the head temperature Th and the cumulative-used amount TA of ink, a determination threshold value JT (%) corresponding to each ink to be used for printing, from a threshold value table TT. FIG. 6A depicts an example of the threshold value table TT.

In the threshold value table TT, determination threshold values JT are recorded in correspondence to combinations of the head temperature Th and the cumulative-used amount TA of ink. For example, in FIG. 6A, when the obtained head temperature Th is within a preset range "medium" and the cumulative-used amount TA of ink obtained for specific ink is within a preset range "large", 75% is obtained as the determination threshold value JT corresponding to the specific ink. In the case of the monochrome printing, the determination threshold value JT corresponding to the black (K) ink is obtained, and in the case of the color printing, one determination threshold value JT corresponding to all inks of CMYK is obtained.

In S120, the CPU 210 obtains partial image data, which corresponds to a partial image to be printed by the single partial printing, of the image data, as notice partial image data, and stores the same in a buffer area 231. For example, the CPU 210 obtains the notice partial image data by receiving the notice partial image data from the terminal apparatus 300. The partial image data is RGB image data expressing a color for each pixel with RGB values, for example. When the obtained partial image data is not the RGB image data, the CPU 210 executes rasterization processing for the partial image data and converts the same into RGB image data.

In S125, the CPU 210 executes color conversion processing for the notice partial image data. The color conversion processing is processing of converting the RGB image data into CMYK image data expressing a color for each pixel with CMYK values. The CMYK values are color values of a CMYK color system, and include gradation values (component values) of four color components C, M, Y and K, i.e., a plurality of component values corresponding to a color of ink. The color conversion processing is executed using a color conversion profile (for example, look-up table) in which the RGB values and the color values (CMYK values) of the CMYK color system are associated. The number of gradations of each component value of the CMYK values is, for example, 256.

In S130, the CPU 210 selects one color from the colors (four colors of C, M, Y and K, in the first illustrative embodiment) of inks to be used for printing as a notice ink color.

In S135, the CPU 210 calculates an index value EV of the pass-used amount PA of ink for the notice ink color. As described above, the pass-used amount PA of ink is the used amount of the specific ink to be used for printing of the partial image in the single partial printing. For example, for a plurality of pixels included in the notice partial image data, a value (also referred to as an integration value TV) obtained by integrating component values corresponding to the notice ink color is calculated. Then, a ratio (%) of the integration value TV to a maximum value $TV_{max}$ of the integration value TV is calculated as the index value EV ($EV=100\times(TV/TV_{max})$). The maximum value $TV_{max}$ is a value obtained by multiplying the number of pixels of the notice partial image by the maximum value (255, in the first illustrative embodiment) of the component value.

In S140, the CPU 210 determines whether the calculated index value EV is equal to or greater than the determination threshold value JT obtained in S115.

When it is determined that the index value EV is smaller than the determination threshold value JT (S140: NO), since an amount per unit time in which the ink having the notice ink color is to be ejected is relatively small, delay in ink supply in the notice ink color does not occur. For this reason, in this case, in S145, the CPU 210 determines a type of dot to be used for the notice ink color and a threshold value of halftone processing as a default. In the default, four types of dots "small", "medium", "large" and "extra-large" are used in the first illustrative embodiment. The threshold value of the halftone processing is determined for each size of dots to be used for printing. For this reason, in S145, threshold values Ts, Tm, Tb, Tbb corresponding to four types of dots "small", "medium", "large" and "extra-large" are determined. The threshold values Ts, Tm, Tb, Tbb are determined to be threshold values Ts0, Tm0, Tb0, Tbb0 of the default recorded in a threshold value table HT with reference to the threshold value table HT shown in FIG. 6B. When the gradation value of each component value of the CMYK values is 0 to 255, the threshold values Ts0, Tm0, Tb0, Tbb0 of the default are 8, 32, 64 and 128, respectively.

When the index value EV is equal to or greater than the determination threshold value JT (S140: YES), since an amount per unit time in which the ink having the notice ink color is to be ejected is relatively large, delay in ink supply in the notice ink color may occur. For this reason, in this case, in S150, the CPU 210 calculates a difference ΔV between the index value EV and the determination threshold value JT (ΔV=EV−JT). In S155, the CPU 210 determines a type of dot to be used for printing of an image (also referred to as 'notice partial image') based on the notice partial image data, and a threshold value of the halftone processing, in correspondence to the difference ΔV. The type of dot and the threshold value are determined with reference to the threshold value table HT shown in FIG. 6B. Here, in S155, while keeping the color (a density of ink) to be expressed, a type of dot to be used for the notice ink color and a threshold value of the halftone processing are determined so that a used amount of ink having the notice ink color, which is used when executing the notice partial printing, is to be reduced, as compared to the case where the threshold values Ts0, Tm0, Tb0, Tbb0 of the default are used.

An ink amount necessary to form dots having the same area (in other words, an ink amount necessary to express the same density) is greater in a case where a small number of dots having a relatively large size are used, as compared to a case where a large number of dots having a relatively small size are used. The reason is that while a spotting area of ink is proportional to a square of a diameter of an ink liquid droplet, an amount (volume) of ink is proportional to a cube of the diameter of the ink liquid droplet. For this reason, in order to express the same density with a smaller amount of ink than a case where the threshold value of the default is used, it is preferable that a ratio of dot having a first size to dots to be used for printing of the notice partial image is set greater than the case where the threshold value of the default is used, and a ratio of dot having a second size greater than the first size is set smaller than the case where the threshold value of the default is used.

Here, when a specific threshold value is determined to be a value (i.e., a value corresponding to a high density) greater than the threshold value of the default, a probability that a dot corresponding to the specific threshold value will be formed becomes lower than the case where the threshold value of the default is used. For example, when the threshold value Tb corresponding to the large dot is determined to be a value (Tb>Tb0) greater than the threshold value Tb0 of the default, a probability that the large dot is to be formed is smaller than the case where the threshold value Tb of the default is used.

Considering the above situations, for example, as shown in the threshold value table HT of FIG. 6B, when the difference ΔV is 0% or greater and smaller than 5%, the types of dots to be used are determined to be the four types "small", "medium", "large" and "extra-large", and the threshold values Ts, Tm, Tb, Tbb corresponding to the four types of dots are determined to be threshold values Ts0, Tm0, TbS, TbbB. That is, in this case, the threshold values Ts, Tm corresponding to the small dot and the medium dot are determined to be the threshold values Ts0, Tm0 of the default. The threshold value Tb corresponding to the large dot is determined to be the threshold value TbS smaller than the threshold value Tb0 of the default (TbS<Tb0), and the threshold value Tbb corresponding to the extra-large dot is determined to be the threshold value TbbB greater than the threshold value Tbb0 of the default (TbbB>Tbb0). For example, when the value, which can be taken as the gradation value of each component value of the CMYK values, is 0 to 255, the threshold value TbS is, for example, 48, and the threshold value TbbB is, for example, 192. As a result, in this case, a ratio of the extra-large dot to the dots to be used for printing of the notice partial image decreases and a ratio of the large dot increases, as compared to the case where the threshold value of the default is used. Also, ratios of the small dot and the medium dot to the dots to be used for printing of the notice partial image are substantially the same, as compared to the case where the threshold value of the default is used. Therefore, as compared to the case where the threshold values Ts0, Tm0, Tb0, Tbb0 of the default are used, the used amount of ink to be used when performing the partial printing is reduced.

When the difference ΔV is 5% or greater and smaller than 15%, the types of dots to be used are determined to be the three types "small", "medium" and "large", and the threshold values Ts, Tm, Tb corresponding to the three types of dots are determined to be the threshold values Ts0, TmS, Tb0. That is, in this case, the threshold values Ts, Tb corresponding to the small dot and the large dot are determined to be the threshold values Ts0, Tb0 of the default. The threshold value Tb corresponding to the medium dot is determined to be the threshold value TmS smaller than the threshold value Tm0 of the default (TmS<Tm0). The extra-large dot is not used. For example, when the value, which can be taken as the gradation value of each component value of the CMYK values, is 0 to 255, the threshold value TmS is, for example, 16. As a result, in this case, the ratio of the extra-large dot to the dots to be used for printing of the notice partial image is reduced (becomes zero (0)), the ratio of the large dot is reduced and the ratio of the medium dot is increased, as compared to the case where the difference ΔV is 0% or greater and smaller than 5%. Also, the ratio of the small dot to the dots to be used for printing of the notice partial image is substantially the same, as compared to the case where the difference ΔV is 0% or greater and smaller than 5%. Therefore, as compared to the case where the difference ΔV is 0% or greater and smaller than 5%, the used amount of ink to be used when performing the partial printing is reduced.

When the difference ΔV is 15% or greater, the types of dots to be used are determined to be the two types "small" and "medium", and the threshold values Ts, Tm corresponding to the two types of dots are determined to be the threshold values TsS, TmS. That is, in this case, the threshold values Ts, Tm corresponding to the small dot and the medium dot are determined to be the threshold values TsS, TmS smaller than the threshold value Ts0, Tm0 of the default (TsS<Ts0, TmS<Tm0). The extra-large dot and the large dot are not used. For example, when the value, which can be taken as the gradation value of each component value of the CMYK values, is 0 to 255, the threshold value TsS is, for example, 2. As a result, in this case, the ratio of the large dot to the dots to be used for printing of the notice partial image is reduced (becomes zero (0)), and the ratios of the small dot and the medium dot are increased, as compared to the case where the difference ΔV is 5% or greater and smaller than 15%. Therefore, as compared to the case where the difference ΔV is 5% or greater and smaller than 15%, the used amount of ink to be used when performing the partial printing is reduced.

As can be seen from the above descriptions, in S155, the types of dots to be used for printing of the notice partial image and the threshold value of the halftone processing are determined so that the greater the difference ΔV is, the smaller the used amount of ink when executing the notice partial printing is.

In S160, the CPU 210 executes the halftone processing for data of the notice ink color of the notice partial image data (CMYK image data) having undergone the color conversion processing, thereby generating dot data, which indicates a formation state of dot for each pixel, for the notice ink color. A value (also referred to as 'dot value') of each pixel included in the dot data is any one of values indicative of formation states of the five types of dots, specifically, five values indicative of five types of dots "extra-large dot", "large dot", "medium dot", "small dot" and "no dot". In the halftone processing, the threshold values determined in S155 are used. The halftone processing will be described later in detail.

In S165, the CPU 210 determines whether all the ink colors have been processed as the notice ink color. When it is determined that there is an ink color not processed yet (S165: NO), the CPU 210 returns to S130. When it is determined that all the ink colors have been processed (S165: YES), the CPU 210 proceeds to S170. At the time when the processing proceeds to S170, the dot data for printing the notice partial image has been generated for all the ink colors.

In S170, the CPU 210 generates printing data by using the dot data. For example, the CPU 210 executes processing of rearranging the dot data in order to be used when the printing mechanism 100 performs the printing and processing of adding a printer control code and a data identification code to the dot data, thereby generating the printing data.

In S175, the CPU 210 controls the main scanning device 130 and the printing head 110 of the printing mechanism 100 to execute the partial printing by using the printing data. Thereby, the notice partial image is printed on the sheet M.

In S180, the CPU 210 controls the conveyor 140 to convey the sheet M by a predetermined amount (specifically, the nozzle length D).

In S185, the CPU 210 determines whether all the partial image data has been processed. In other words, the CPU 210 determines whether the printing of the print image based on the image data has been completed. When it is determined that all the partial image data has been processed (S185: YES), the CPU 210 ends the image processing. When it is determined that there is the partial image data not processed yet (S185: NO), the CPU 210 returns to S120.

A-4. Halftone Processing

Figure 7A:
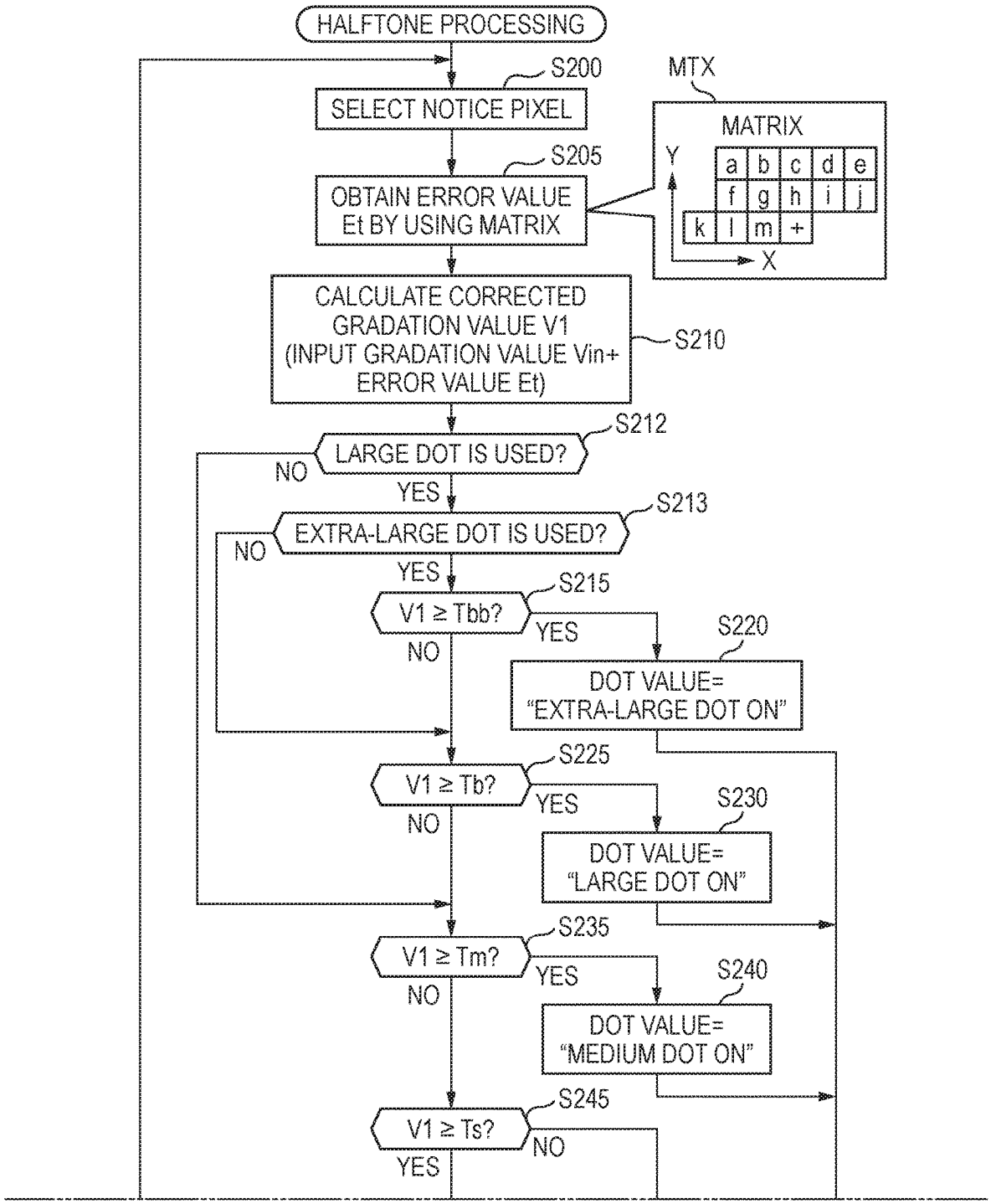
FIGS. 7A and 7B illustrate a flowchart of halftone processing.
Figure 7B:
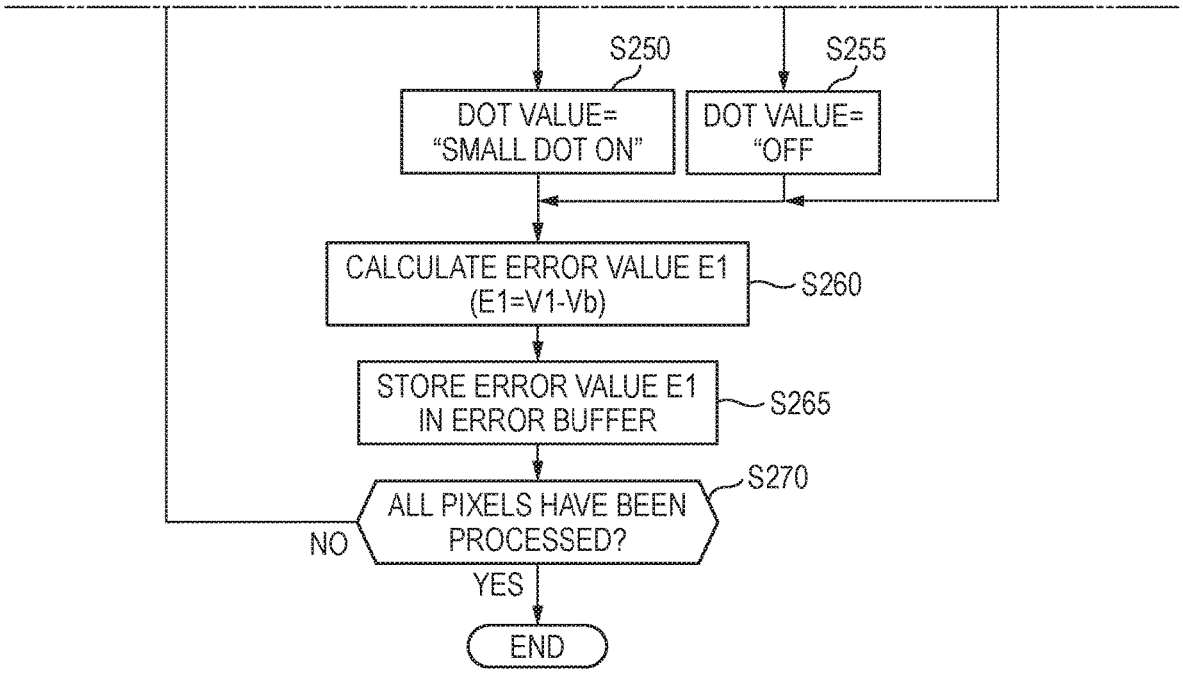

The halftone processing of S160 shown in FIG. 5A is described. In the first illustrative embodiment, the halftone processing is executed using an error collection method. FIGS. 7A and 7B illustrate a flowchart of the halftone processing. In S200 of FIG. 7A, the CPU 210 selects one notice pixel from the plurality of pixels of the notice partial image. The notice partial image includes a plurality of raster lines extending in a direction (X direction in FIG. 4)

corresponding to the main scanning direction during the printing. In the first illustrative embodiment, the plurality of raster lines is sequentially processed from an upstream raster line with respect to the sub-scanning direction, for example. From the plurality of pixels included in the raster line, which is one processing target, the notice pixel is sequentially selected from an upstream pixel with respect to the X direction in FIG. 4, for example.

In S205, the CPU 210 obtains an error value Et to be added to the notice pixel by using a matrix MTX (FIG. 7A) and an error value E1 (which will be described later) calculated for a pixel, which has been processed already as the notice pixel prior to the current notice pixel, and stored in an error buffer. The error buffer is a predetermined memory area set in the buffer area 231 (FIG. 1). In the matrix MTX, weight values greater than zero are allotted to pixels arranged at predetermined relative positions around the notice pixel. In the matrix MTX of FIG. 7A, a symbol "+" indicates the notice pixel, and the weight values a to m are allotted to the surrounding pixels. A sum of the weight values a to m is 1. The CPU 210 calculates, as the error value Et, a sum of weight values of a plurality of error values E1 of the surrounding processed pixels, in accordance with the weight values.

In S210, the CPU 210 calculates, as a corrected gradation value V1 (V1=Vin+Et), a sum of the error value Et and a gradation value (also referred to as 'input gradation value Vin') of the component, which corresponds to the notice ink color, of the CMYK values of the notice pixel.

In S212, the CPU 210 determines whether it has been determined in S145 or S155 of FIG. 5A that the large dot is to be used for the notice ink color. When it is determined that the large dot is to be used (S212: YES), the CPU 210 proceeds to S213. When it is determined that the large dot is not to be used (S212: NO), the CPU 210 proceeds to S235.

In S213, the CPU 210 determines whether it has been determined in S145 or S155 of FIG. 5A that the extra-large dot is to be used for the notice ink color. When it is determined that the extra-large dot is to be used (S213: YES), the CPU 210 proceeds to S215. When it is determined that the extra-large dot is not to be used (S213: NO), the CPU 210 proceeds to S225.

In S215, the CPU 210 compares the corrected gradation value V1 and the threshold value Tbb corresponding to the extra-large dot. The threshold value Tbb has been already determined in S145 or S155 of FIG. 5A. When the corrected gradation value V1 is smaller than the threshold value Tbb (S215: NO), the CPU 210 proceeds to S225. When the corrected gradation value V1 is equal to or greater than the threshold value Tbb (S215: YES), the CPU 210 determines in S220 the dot value of the component corresponding to the notice ink color of the notice pixel, as a value (also referred to as 'extra-large dot ON') indicative of the formation of the extra-large dot, and proceeds to S260.

In S225, the CPU 210 compares the corrected gradation value V1 and the threshold value Tb corresponding to the large dot. The threshold value Tb has been already determined in S145 or S155 of FIG. 5A. When the corrected gradation value V1 is smaller than the threshold value Tb (S225: NO), the CPU 210 proceeds to S235. When the corrected gradation value V1 is equal to or greater than the threshold value Tb (S225: YES), the CPU 210 determines in S230 the dot value of the component corresponding to the notice ink color of the notice pixel, as a value (also referred to as 'large dot ON') indicative of the formation of the large dot, and proceeds to S260.

In S235, the CPU 210 compares the corrected gradation value V1 and the threshold value Tm corresponding to the medium dot. The threshold value Tm has been already determined in S145 or S155 of FIG. 5A. When the corrected gradation value V1 is smaller than the threshold value Tm (S235: NO), the CPU 210 proceeds to S245. When the corrected gradation value V1 is equal to or greater than the threshold value Tm (S235: YES), the CPU 210 determines in S240 the dot value of the component corresponding to the notice ink color of the notice pixel, as a value (also referred to as 'medium dot ON') indicative of the formation of the medium dot, and proceeds to S260.

In S245, the CPU 210 compares the corrected gradation value V1 and the threshold value Ts corresponding to the small dot. The threshold value Ts has been already determined in S145 or S155 of FIG. 5A. When the corrected gradation value V1 is smaller than the threshold value Ts (S245: NO), the CPU 210 proceeds to S255. When the corrected gradation value V1 is equal to or greater than the threshold value Ts (S245: YES), the CPU 210 determines in S250 the dot value of the component corresponding to the notice ink color of the notice pixel, as a value (also referred to as 'small dot ON') indicative of the formation of the small dot, and proceeds to S260.

In S255, the CPU 210 determines the dot value of the component corresponding to the notice ink color of the notice pixel, as a value (also referred to as 'OFF') indicative of non-formation of a dot, and proceeds to S260.

In S260, the CPU 210 calculates a value obtained by subtracting a density value Vb of a dot to be formed (i.e., a density value Vb corresponding to the determined dot value) from the corrected gradation value V1, as the error value E1 (E1=V1−Vb) of the notice pixel. For example, when the value, which can be taken as the gradation value of each component value of the CMYK values, is 0 to 255, the density value Vb corresponding to each of the four types of dots "small", "medium", "large" and "extra-large" is 32, 64, 128 and 255, respectively.

In S265, the CPU 210 stores the calculated error value E1 of the notice pixel in an address, which corresponds to the notice pixel, in the error buffer.

In S270, the CPU 210 determines whether all the pixels of the notice partial image have been processed as the notice pixel. When it is determined that there is a pixel not processed yet (S270: NO), the CPU 210 returns to S200. When it is determined that all the pixels have been processed (S270: YES), the CPU 210 ends the halftone processing.

According to the first illustrative embodiment, when the index value EV is smaller than the determination threshold value JT (S140: NO), the first halftone processing using the threshold value of the default is executed (S145 and S160 in FIG. 5A), and when the index value EV is equal to or greater than the determination threshold value JT (S140: YES), the second halftone processing using the threshold value different from the threshold value of the default is executed (S150, S155 and S160 in FIG. 5A). The condition "the index value EV is equal to or greater than the determination threshold value JT" can be said as a specific condition indicating that the ink supply from the ink supplier 150 to the printing head 110 may be delayed when printing the notice partial image.

In the second halftone processing, the threshold value Tbb corresponding to the extra-large dot is determined to be the threshold value TbbB greater than the threshold value Tbb0 of the default or the dot value is not determined to be "extra-large dot ON" (FIG. 6B). For this reason, when the dot data generated in the first halftone processing is set as first dot data and the dot data generated in the second halftone processing is set as second dot data, the ratio of the extra-large dots included in the printed image based on the specific second dot data generated using the specific image data becomes smaller than the ratio of the extra-large dots included in the printed image based on the specific first dot data generated using the specific image data. As the ratio of the extra-large dots is reduced, the ratio of dots of at least one type of the large dot, the medium dot and the small dot included in the printed image based on the specific second dot data becomes greater than the ratio of dots of the same type included in the printed image based on the specific first dot data (FIG. 6B).

Even when the threshold value or the type of dot to be used is changed, since the density of the printed image based on the generated dot data is kept in the halftone processing of FIGS. 7A and 7B, the density of the printed image based on the specific second dot data is substantially the same as the density of the printed image based on the specific first dot data. That is, when dots, which are smaller than the case where the threshold value of the default is used, are generated, a positive error (the error E1 calculated in S260 of FIG. 7B) to diffuse to the surrounding pixels increases. As a result, the small dots are likely to be generated even in the surrounding pixels. Therefore, the total number of dots included in the printed image based on the specific second dot data is greater than the total number of dots included in the image based on the specific first dot data.

As described above, when expressing the same density, in general, as the small dots are used, the used amount of the ink is reduced. Therefore, according to the first illustrative embodiment, in the image to be printed, when the specific condition, which indicates that the ink supply from the ink supplier 150 to the printing head 110 may be delayed, is satisfied, the ratio of dots smaller than the extra-large dot increases and the ratio of extra-large dots decreases, as compared to the case where the specific condition is not satisfied. As a result, when the ink supply from the ink supplier 150 to the printing head 110 may be delayed, the used amount of the ink is suppressed, so that it is possible to suppress the delay in ink supply. Also, since it is possible to suppress the delay in ink supply simply by changing the type of dot to be used, it is possible to suppress a situation where the printing speed is lowered so as to suppress the delay in ink supply. For example, in order to suppress the delay in ink supply, a method where a printing pause time is provided between the single partial printing and next partial printing is considered. In this case, the printing speed is lowered due to the printing pause time. However, according to the first illustrative embodiment, it is possible to suppress such malfunction in the first illustrative embodiment.

In the meantime, when the small number of large dots is used, the used amount of the ink is increased, as compared to the case where the large number of small dots is used. However, since the ejection of the ink is stabilized, positional deviation of dots is difficult to occur. The reason is that the large ink liquid droplet is less likely to be influenced by air resistance between the ejection and the spotting and is thus difficult to flow, as compared to the small ink liquid droplet. For this reason, when the small number of large dots is used, color shift and blurring due to the position deviation of dots are difficult to occur. In the first illustrative embodiment, when the delay in ink supply does not occur (when the specific condition is not satisfied), the threshold value of the default is used. Therefore, when the delay in ink supply does not occur, the small number of large dots is used, as compared to the case where the delay in ink supply may occur, so that it is possible to suppress the positional deviation of dots, thereby improving an image quality of the printed image OI.

Also, in the first illustrative embodiment, since the total number of dots included in the printed image based on the specific second dot data is greater than the total number of dots included in the image based on the specific first dot data, it is possible to suppress the situation where the printing density is lowered so as to suppress the delay in ink supply. For example, in order to suppress the delay in ink supply, a method where the density of the printed image is reduced by reducing the number of dots to be included in the printed image is considered. In this case, since the density of the printed image is reduced, the image quality of the printed image may be lowered. However, according to the first illustrative embodiment, it is possible to suppress such malfunction.

Also, according to the first illustrative embodiment, in the first halftone processing to be executed when the specific condition is not satisfied, when the corrected gradation value V1 of the notice pixel based on the image data indicates a density equal to or greater than the threshold value Tbb0, the extra-large dot corresponding to the notice pixel is determined to be formed (FIG. 6B, YES in S215 of FIG. 7A, S220), and when the corrected gradation value V1 of the notice pixel indicates a density smaller than the threshold value Tbb0, the extra-large dot corresponding to the notice pixel is determined not to be formed (FIG. 6B, NO in S215 of FIG. 7A). In the processing, which is to be executed when the difference ΔV is 0% or greater and smaller than 5%, of the second halftone processing to be executed when the specific condition is satisfied, when the corrected gradation value V1 of the notice pixel indicates a density equal to or greater than the threshold value TbbB greater than the threshold value Tbb0, the extra-large dot corresponding to the notice pixel is determined to be formed (FIG. 6B, YES in S215 of FIG. 7A, S220), and when the corrected gradation value V1 of the notice pixel indicates a density smaller than the threshold value TbbB, the extra-large dot corresponding to the notice pixel is determined not to be formed (FIG. 6B, NO in S215 of FIG. 7A). In this way, regarding the threshold value for determining whether or not to form the extra-large dot, in the second halftone processing, the threshold value TbbB greater than the threshold value Tbb0 used in the first halftone processing is used. As a result, when the specific condition is satisfied, it is possible to simply lower the ratio of extra-large dots to be included in the image to be printed, as compared to the case where the specific condition is not satisfied. For example, as described later in the second illustrative embodiment, as a method of lowering the ratio of extra-large dots to be included in the image to be printed, a method of, after generating dot data, replacing the dot value indicative of "extra-large dot ON" in the dot data with a plurality of dot values indicative of the formation of dots smaller than the extra-large dot is considered. In the first illustrative embodiment, as compared to this method, since it is not necessary to execute the processing of replacing the dot value, it is possible to lower the ratio of extra-large dots to be included in the image to be printed more simply.

Also, according to the first illustrative embodiment, the printed image based on the first dot data generated in the first halftone processing includes the extra-large dot and the dots (for example, "small", "medium" and "large" dots) smaller than the extra-large dot (FIG. 6B, YES in S212 and S213 of FIG. 7A). In contrast, the printed image based on the second dot data generated in the processing, which is executed when the difference ΔV is 5% or greater, of the second halftone processing includes the dots smaller than the extra-large dot, and does not include the extra-large dot (FIG. 6B, NO in S212 or NO in S213 of FIG. 7A). In this case, since the printed image based on the second dot data does not include the extra-large dot of which the used amount of the ink is large, it is possible to effectively suppress the delay in ink supply.

Also, according to the first illustrative embodiment, the CPU 210 determines whether the specific condition is satisfied, for each ink of C, M, Y and K (S140 in FIG. 5A). When the specific condition is not satisfied for the cyan (C) ink (S140: NO in FIG. 5A), the CPU 210 generates the first dot data for the cyan (C) ink by using the threshold value of the default (S145 and S160 in FIG. 5A). When the specific condition is satisfied for the cyan (C) ink (S140: YES in FIG. 5A), the CPU 210 generates the second dot data different from the default for the cyan (C) ink (S150, S155 and S160 in FIG. 5A). Likewise, when the specific condition is not satisfied for the magenta (M) ink (S140: NO in FIG. 5A), the CPU 210 generates the first dot data for the magenta (M) ink by using the threshold value of the default (S145 and S160 in FIG. 5A). When the specific condition is satisfied for the magenta (M) ink (S140: YES in FIG. 5A), the CPU 210 generates the second dot data different from the default for the magenta (M) ink (S150, S155 and S160 in FIG. 5A). According to this configuration, when the plurality of types of inks (for example, the cyan (C) ink and the magenta (M) ink) is used, it is possible to suppress the delay in each ink supply.

Also, according to the first illustrative embodiment, the CPU 210 determines whether the specific condition is satisfied, in each partial printing for printing the partial image (S140 in FIG. 5A), and generates the dot data in each partial printing by using the partial image data. As a result, it is possible to suppress the delay in ink supply in each partial printing.

Also, according to the first illustrative embodiment, since the CPU 210 of the printer 200 executes the image processing of FIGS. 5A and 5B, it is possible to suppress the delay in ink supply only with the printer 200, without depending on the processing of the terminal apparatus 300 (for example, processing of the driver installed in the terminal apparatus 300), for example.

B. Second Illustrative Embodiment

Figure 8A:
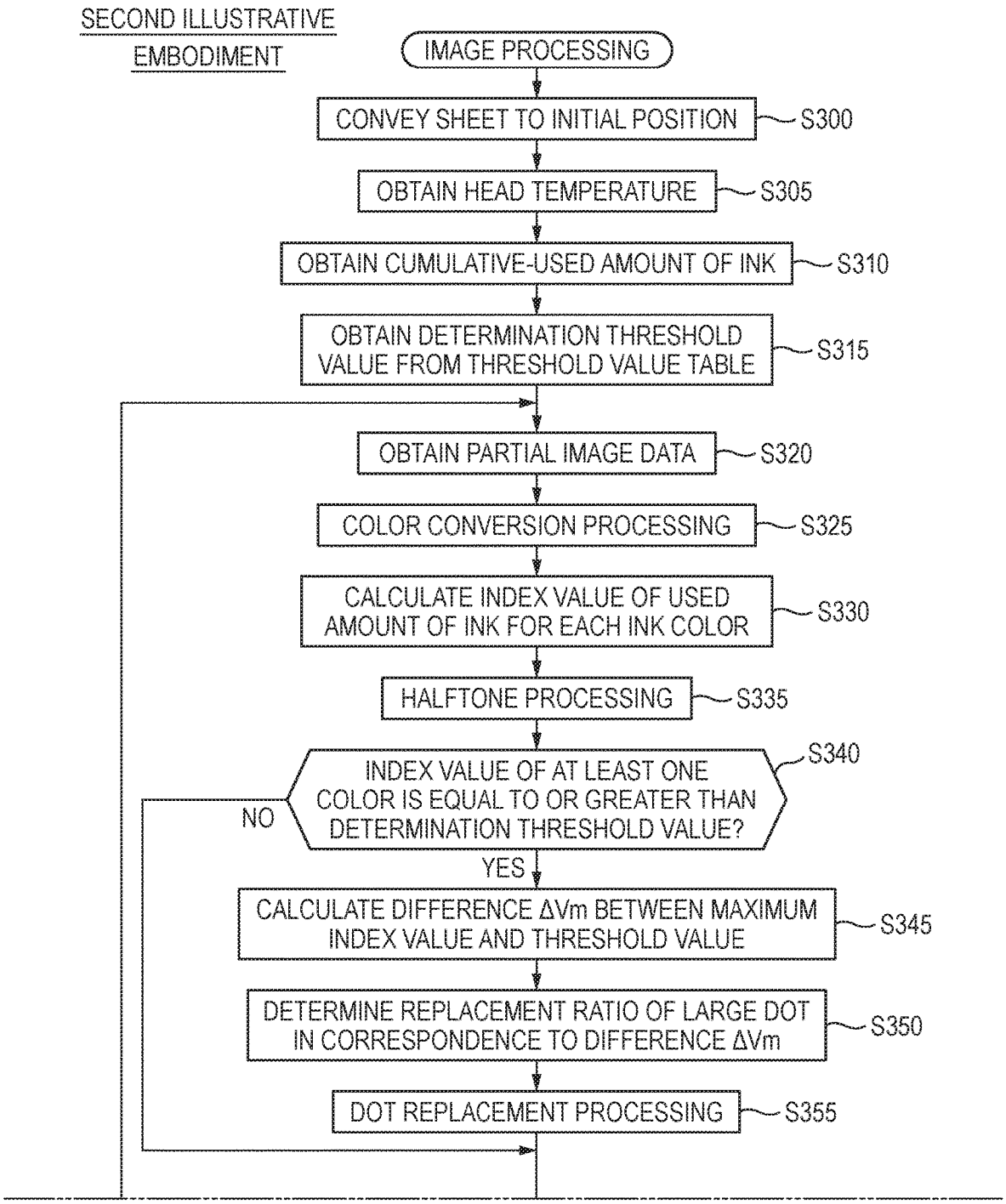
FIGS. 8A and 8B illustrate a flowchart of image processing of a second illustrative embodiment.
Figure 8B:
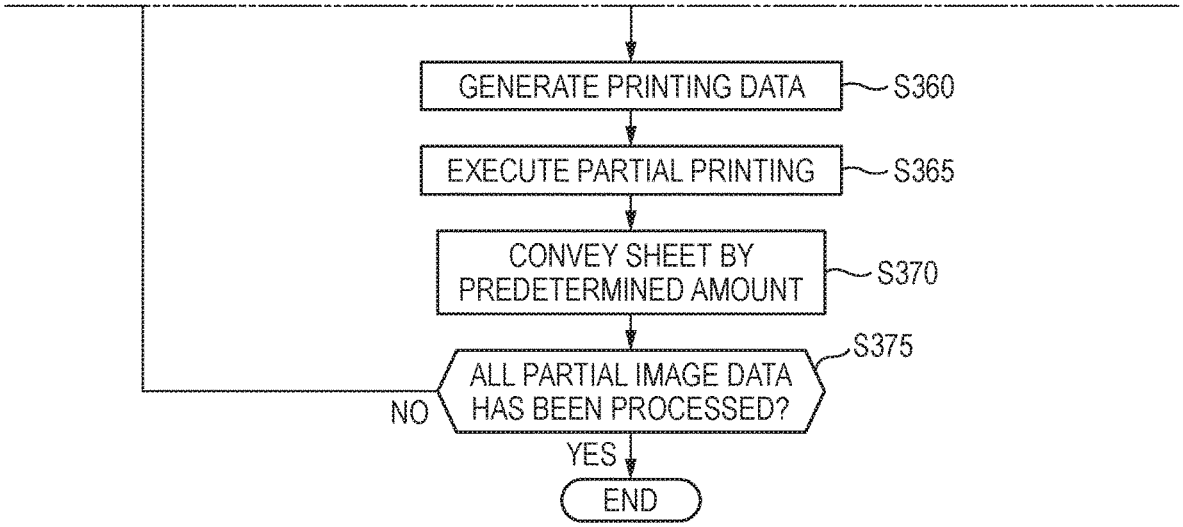

In a second illustrative embodiment, the head driver 120 (FIG. 1) drives the printing head 110 to form the three types of dots "small", "medium" and "large" on the sheet M. In the second illustrative embodiment, contents of the image processing are different from the first illustrative embodiment. FIGS. 8A and 8B illustrate a flowchart of the image processing of the second illustrative embodiment. The control table group TG of the second illustrative embodiment includes a replacement ratio setting table RT, instead of the threshold value table HT of FIG. 6B. FIG. 9 depicts an example of the replacement ratio setting table RT. The setting table RT is used in the image processing of FIGS. 8A and 8B.

The processing of S300 to S325 in FIG. 8A is the same as the processing of S100 to S125 in FIG. 5A.

In S320, like S320 of FIG. 5B, the CPU 210 obtains the partial image data, which corresponds to the partial image to be printed by the single partial printing, of the image data, as the notice partial image data, and stores the same in the buffer area 331.

In S330, the CPU 210 calculates the index value EV of the pass-used amount PA of ink for each ink of C, M, Y and K. The index value EV of one ink color is calculated in the same method as the first illustrative embodiment.

In S335, the halftone processing is executed for the notice partial image data (CMYK image data) having undergone the color conversion processing, thereby generating dot data indicative of formation states of dots for each pixel and each color component (each ink color). The dot data generated in S335 is referred to as first dot data in the second illustrative embodiment. In the halftone processing, a well-known method, for example, an error collection method or a dithering method is used. A value (also referred to as 'dot value') of each pixel included in the dot data is any one of values indicative of formation states of four types of dots, specifically, four values indicative of formation states of four types of dots "large dot", "medium dot", "small dot" and "no dot". In the halftone processing, the threshold values Ts0, Tm0, Tb0 of the default of the first illustrative embodiment are used.

In S340, the CPU 210 determines whether the index value EV of at least one color of the index values EV of the respective inks of C, M, Y and K calculated already in S330 is equal to or greater than the determination threshold value JT. When it is determined that the index value EV of at least one color is equal to or greater than the determination threshold value JT (S340: YES), the CPU 210 executes processing of S345 to S355 by using the first dot data, thereby generating processed dot data. The processed dot data generated in S345 to S355 is referred to as second dot data, in the second illustrative embodiment. When it is determined that the index values EV of all the ink colors are smaller than the determination threshold value JT (S340: NO), the CPU 210 skips the processing of S345 to S355. Therefore, in this case, the second dot data is not generated.

In S345, the CPU 210 calculates a difference ΔVm between a maximum index value EVm of the index values EV of the respective ink colors of C, M, Y and K and the determination threshold value JT (ΔVm=EVm−JT).

In S350, the CPU 210 determines a replacement ratio Rb of the large dot, in correspondence to the difference ΔVm. The replacement ratio Rb is determined with reference to the setting table RT of FIG. 9. As shown in the setting table RT, the replacement ratio Rb is determined to gradually increase as the difference ΔVm increases. In the example of FIG. 9, when the difference ΔVm is 0% or greater and smaller than 5%, the replacement ratio Rb is determined to be 50%, when the difference ΔVm is 5% or greater and smaller than 15%, the replacement ratio Rb is determined to be 75%, and when the difference ΔVm is equal to or greater than 15%, the replacement ratio Rb is determined to be 100%.

In S355, the CPU 210 executes dot replacement processing for the first dot data, thereby generating processed dot data (second dot data). The dot replacement processing is processing of replacing each large dot of a replacement target of the large dots in the dot image based on the first dot data with two medium dots.

Figure 10A:
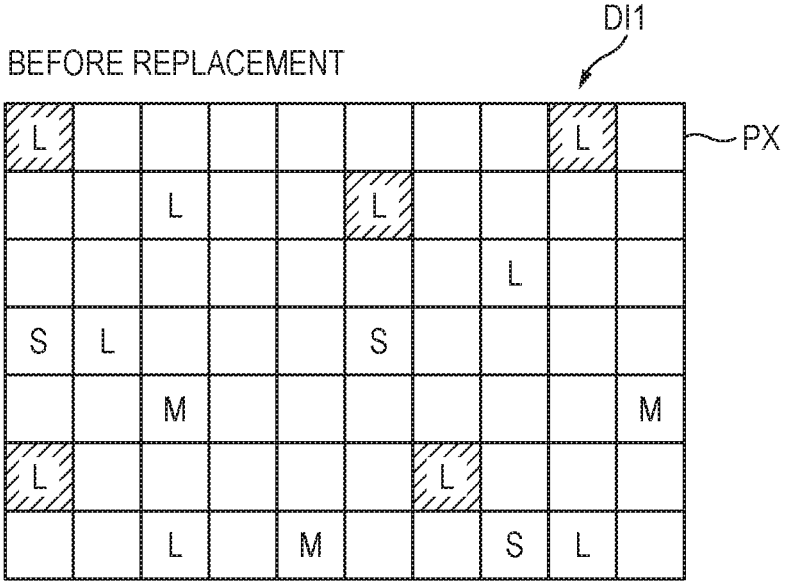
FIGS. 10A and 10B illustrate dot replacement processing.
Figure 10B:
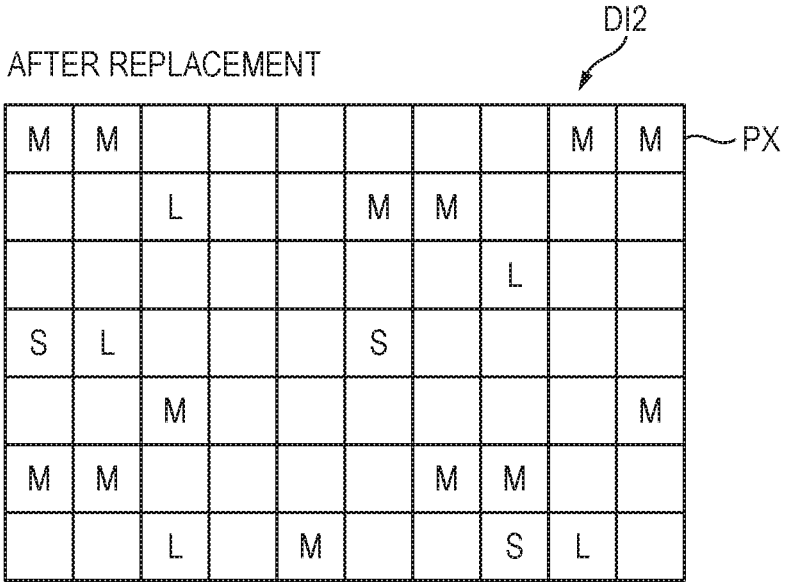

FIGS. 10A and 10B illustrate the dot replacement processing. FIG. 10A depicts an example of a dot image DI1 based on the first dot data before the dot replacement processing, and FIG. 10B depicts an example of a dot image DI2 based on the second dot data after the dot replacement processing. In the dot images DI1, DI2, a plurality of rectangles aligned in a matrix shape indicates pixels PX. Characters "S", "M" and "L" in the respective pixels PX indicate that the small dot, the medium dot and the large dot are arranged at positions corresponding to the respective pixels. The empty pixel PX indicates that no dot corresponding to the pixel PX is arranged.

In the dot replacement processing, the CPU 210 specifies a plurality of large dots in the dot image DI1, based on the first dot data. The CPU 210 determines large dots, which correspond to the replacement ratio Rb, of the plurality of specific large dots, as large dots of a replacement target. For example, the large dot of the replacement target is randomly selected from the plurality of specific large dots. In FIG. 10A, the hatched pixels PX are pixels in which large dots determined as the replacement target are located. The CPU 210 replaces the large dot of the replacement target in the dot image DI1 to one medium dot, and adds one medium dot to a position adjacent to the large dot of the replacement target. In other words, the CPU 210 changes the dot value, which corresponds to the large dot of the replacement target, to "medium dot ON" and the dot value, which corresponds to the pixel adjacent to the large dot of the replacement target, to "medium dot ON", in the first dot data. In S355, the dot replacement processing is executed for the first dot data of each component of C, M, Y and K. As a result, the second dot data of each component of C, M, Y and K is generated.

An ink amount to be used when printing the dot image DI2 becomes smaller than an ink amount to be used when printing the dot image DI1. In the second illustrative embodiment, since an area of one large dot is substantially the same as a summed area of two medium dots, a density of the dot image DI1 and a density of the dot image DI2 are substantially the same.

In S360, the CPU 210 generates printing data by using the dot data. The dot data to be used is the second dot data when the processing of S345 to S355 is executed, and is the first dot data when the processing of S345 to S355 is not executed.

In S365, the CPU 210 controls the main scanning device 130 and the printing head 110 of the printing mechanism 100 by using the printing data, thereby executing the partial printing. In S370, the CPU 210 controls the conveyor 140 to convey the sheet M by a predetermined amount (specifically, the nozzle length D).

In S375, the CPU 210 determines whether all the partial image data has been processed. In other words, the CPU 210 determines whether the printing of the printed image based on the image data has been completed. When it is determined that all the partial image data has been processed (S375: YES), the CPU 210 ends the image processing. When it is determined that there is partial image data not processed yet (S375: NO), the CPU 210 returns to S320.

According to the second illustrative embodiment, like the first illustrative embodiment, when the specific condition, which indicates that the ink supply from the ink supplier 150 to the printing head 110 may be delayed, is not satisfied (S340: NO), the dot image DI1 (FIG. 10A) based on the first dot data is printed, and when the specific condition is satisfied (S340: YES), the dot image DI2 (FIG. 10B) based on the second dot data is printed. The ratio of the large dots included in the dot image DI2 becomes smaller than the ratio of the large dots included in the dot image DI1, and the ratio of the medium dots included in the dot image DI2 becomes greater than the ratio of the medium dots included in the dot image DI1 (FIGS. 10A and 10B). Also, the total number of dots based on the dot image DI2 becomes greater than the total number of dots included in the dot image DI1 (FIGS. 10A and 10B). As a result, like the first illustrative embodiment, while suppressing the delay in ink supply, it is possible to suppress the situation where the printing speed is lowered so as to suppress the delay in ink supply. Also, it is possible to suppress a situation where the density of the image to be printed is lowered so as to suppress the delay in ink supply.

Also, in the second illustrative embodiment, the dot data generation processing (also referred to as 'first generation processing'), which is executed when the specific condition is not satisfied (NO in S340 of FIG. 8A), includes first processing (S325 and S330 in FIG. 8A) of generating the first dot data. Also, the dot data generation processing (also referred to as 'second generation processing'), which is executed when the specific condition is satisfied (YES in S340 of FIG. 8A), includes the first processing (S325 and S330 in FIG. 8A) of generating the first dot data, and second processing (S355 in FIG. 8A) of generating the second dot data by using the first dot data generated in the first processing, as second processing to be executed thereafter. The dot image DI2 based on the second dot data is an image obtained by replacing the N large dots (N: an integer of 1 or greater) in the dot image DI1 based on the first dot data with the (2×N) medium dots (FIGS. 10A and 10B). As a result, it is possible to appropriately generate the second dot data by using the first dot data. For example, in the second illustrative embodiment, as described above, since the area of one large dot is substantially the same as the summed area of the two medium dots, it is possible to generate the second dot data by the replacement so that the density of the dot image DI1 and the density of the dot image DI2 are to be substantially the same.

Also, in the second illustrative embodiment, when generating the second dot data by executing the processing of S355, the replacement ratio Rb, which indicates the ratio of dots, which are to be replaced with the medium dots, of the large dots in the dot image DI1, is determined on the basis of the difference ΔVm (S345 and S350 in FIG. 8A, FIG. 9). When the difference ΔVm is a first difference (for example, a value of 0% or greater and smaller than 5%), the replacement ratio Rb is determined to be a first ratio (for example, 50%), and when the difference ΔVm is a second difference (for example, a value of 15% or greater) greater than the first difference, the replacement ratio Rb is determined to be a second ratio (for example, 100%) greater than the first ratio. As a result, since the replacement ratio Rb is determined on the basis of the difference ΔVm, it is possible to appropriately suppress the delay in ink supply. The greater the difference ΔVm is, the larger the amount of ink to be used for the notice partial printing is and the delay in ink supply is more likely to occur. Therefore, it can be said that it is necessary to suppress the used amount of the ink by increasing the replacement ratio Rb.

Also, in the second illustrative embodiment, it is determined whether the specific condition is satisfied for each of C, M, Y and K (S340 in FIG. 8). For example, when it is determined that the specific condition is not satisfied for all the inks (S340: NO in FIG. 8A), the dot image DI1 based on the first dot data is printed with respect to all the inks, and when it is determined that the specific condition is satisfied for at least one ink (S340: YES in FIG. 8A), the dot image DI2 based on the second dot data is printed with respect to all the inks. It is assumed that the dot image DI1, in which the large dot is not replaced with the medium dot, is printed with respect to some ink of C, M, Y and K and the dot image DI2, in which the large dot is replaced with the medium dot, is printed with respect to the other inks. In this case, as compared to a case where the dot image DI2 is printed with respect to all the inks, the overlapping aspect of the inks of C, M, Y and K in the image to be printed is different from the assumption. Therefore, there is a possibility that a targeted color tone may not be reproduced. However, according to the above configuration, since it is possible to suppress such problem, it is possible to suppress an image quality of the image to be printed from being deteriorated.

C. Modified Embodiments (1) In the first illustrative embodiment, the four types of dots "small", "medium", "large" and "extra-large" are used for printing. However, the present disclosure is not limited thereto. For example, the three types of dots "small", "medium" and "large" may be used, and the two types of dots "small" and "medium" may be used. In general, a plurality of types of dots including a first type of dots and a second type of dots larger than the first type of dots may be used. A ratio of the first type of dots included in the image based on the specific second dot data, which is generated using the specific image data, is greater than a ratio of the first type of dots included in the image based on the specific first dot data, which is generated using the specific image data, and a ratio of the second type of dots included in the image based on the specific second dot data is smaller than a ratio of the second type of dots included in the image based on the specific first dot data. This applies to the second illustrative embodiment, too.

(2) In the first illustrative embodiment, when the specific condition, which indicates that the ink supply may be delayed, is satisfied, the different types of dots are used in correspondence to the difference ΔV, and the threshold values of the different halftone processing are used in correspondence to the difference ΔV (S155 in FIG. 5A). Instead of this configuration, in the image processing of the first illustrative embodiment, the difference ΔV may not be calculated. In this case, for example, when the specific condition is not satisfied, the partial printing may be executed using the extra-large dot, and when the specific condition is satisfied, the partial printing may be executed without using the extra-large dot. Alternatively, when the specific condition is satisfied, the partial printing may be executed so that the number of the extra-large dots to be included in the partial image to be printed is smaller, as compared to the case where the specific condition is not satisfied.

(3) In the second illustrative embodiment, when the specific condition, which indicates that the ink supply may be delayed, is satisfied, the different replacement ratios Rb are used in correspondence to the difference ΔVm (S350 in FIG. 8A, FIG. 9). Instead of this configuration, in the image processing of the second illustrative embodiment, the difference ΔVm may not be calculated. In this case, for example, when the specific condition is satisfied, the dot replacement processing may be used using the same replacement ratio Rb (for example, 50%) all the time, irrespective of the difference ΔVm.

(4) In the second illustrative embodiment as described above, in the dot replacement processing, one large dot is replaced with two medium dots. However, the present disclosure is not limited thereto. For example, the different dot replacement processing may be adopted, in correspondence to the sizes of "large", "medium" and "small" dots to be formed. For example, one large dot may be replaced with three small dots or one large dot may be replaced with one medium dot and one small dot. Alternatively, two large dots may be replaced with three medium dots. Generally speaking, when the first type of dot (for example, the small dot and the medium dot) and the second type of dot (for example, the large dot) larger than the first type of dot are used, the dot image DI2 after the replacement processing may be an image obtained by replacing the second type of N dots (N: an integer of 1 or greater) in the dot image DI1 before the replacement processing with the first type of M dots (M: an integer greater than N (M>N)).

(5) In the first illustrative embodiment described above, since the error collection method is used in the halftone processing, when the specific condition is satisfied, the threshold values Vs, Vm, Vb, Vbb used in the error collection method are changed to values, which are different from the values in the case where the specific condition is not used. Instead of this configuration, when an error diffusion method is used in the halftone processing, a threshold value to be used in the error diffusion method is changed. Also, when a dithering method is used in the halftone processing, a threshold value to be used in the dithering method is changed. For example, in the dithering method, four types of threshold values corresponding to the four types of dots "extra-large", "large", "medium" and "small" are set for each pixel by a dither matrix. When the specific condition is satisfied, the threshold value corresponding to the extra-large dot is changed to a value greater than a value in the case where the specific condition is not satisfied, and the threshold values corresponding to the large dot and the medium dot are changed to values greater than values in the case where the specific condition is not satisfied, for example.

(6) In the respective illustrative embodiment as described above, it is determined whether the specific condition, which indicates that the ink supply may be delayed, is satisfied in each partial printing (S140 in FIG. 5A, S340). Instead of this configuration, it may be determined whether the specific condition is satisfied whenever the printed image OI is printed. In this case, for example, an index value relating to an ink amount to be used when printing the entire printed image OI is calculated, and when the index value is equal to or greater than a predetermined threshold value, it is determined that the specific condition is satisfied.

(7) In the respective illustrative embodiment as described above, the condition indicating that the delay in ink supply may occur is determined using the head temperature Th, the cumulative-used amount TA of ink and the index value EV. However, the present disclosure is not limited thereto. For example, only the head temperature Th and the index value EV may be used. In this case, for example, in the threshold value table TT of FIG. 6A, only three determination threshold values JT corresponding to three types of head temperatures Th (low, medium and high) may be defined. Also, only the cumulative-used amount TA of ink and the index value EV may be used. In this case, in the threshold value table TT, only three determination threshold values JT corresponding to three types of cumulative-used amounts TA of ink (small, medium and large) may be defined.

(8) In addition, instead of the index value EV, a separate index value relating to the used amount of the ink may be adopted. For example, the separate index value may be a total number of dots of each ink to be formed when printing the notice partial image. Also, instead of the cumulative-used amount TA of ink, a separate index value relating to the cumulative-used amount of ink may be adopted. For example, the separate index value may be a cumulative number of printed sheets or may be a cumulative number of replacement times of the ink cartridge. It can be said that the greater the cumulative number of printed sheets or the cumulative number of replacement times is, the larger the cumulative-used amount TA of ink is. Therefore, it can be said that the cumulative number of printed sheets is an index value relating to the cumulative-used amount TA of ink.

(9) In the printing mechanism 100 of the above illustrative embodiments, the sub-scanning in which the conveyor 140 conveys the sheet M to move the sheet M relative to the printing head 110 in the conveying direction is performed. Instead of this configuration, the sub-scanning may be performed by moving the printing head 110 relative to the fixed sheet M in an opposite direction to the conveying direction.

In the above illustrative embodiments, the printing mechanism 100 is a serial printer including the main scanning device 130 and configured to drive the printing head 110 for performing the partial printing during the main scanning. Instead of this configuration, the printing mechanism 100 may be a so-called line printer in which the main scanning device 130 is not provided and a printing head including a plurality of nozzles aligned over substantially the same length as a width of the sheet M in a direction perpendicular to the conveying direction is provided. In the line printer, the printing is executed without performing the main scanning. In this case, since there is no concept of the partial printing, it may be determined whether the specific condition is satisfied whenever the printed image OI is printed, as described above, for example.

(10) As the printing medium, instead of the sheet M, other media such as an OHP film, a CD-ROM, and a DVD-ROM may be adopted.

(11) In the above illustrative embodiments, the device configured to execute the image processing of FIGS. 5A, 5B and 8 is the CPU 210 of the printer 200. Instead of this configuration, the device configured to execute the image processing of FIGS. 5A, 5B and 8 may be other device, for example, the terminal apparatus 300. In this case, for example, the terminal apparatus 300 operates as a printer driver by executing a driver program, and controls the printer 200, which is the printing execution device, as a part of functions of the printer driver, thereby executing the image processing of FIGS. 5A, 5B and 8. In this case, the terminal apparatus 300 performs the conveyance of the sheet M in S100 and S180 by transmitting a conveyance command including information about a conveying amount of the sheet M to the printer 200, for example. Also, in this case, the terminal apparatus 300 obtains the head temperature Th and the cumulative-used amount TA of ink from the printer 200, in S105 and S110 of FIG. 5A. Also, the terminal apparatus 300 performs the partial printing of S175 in FIG. 5B by transmitting a partial printing command including the printing data to the printer 200, for example.

As can be seen from the above descriptions, in the respective illustrative embodiment as described above, the printing mechanism 100 is an example of the printing execution device. Like this modified aspects, when the terminal apparatus 300 executes the image processing, the entire printer 200 configured to execute the printing is an example of the printing execution device.

(12) The device configured to execute the image processing of FIGS. 5A, 5B and 8 may be a server configured to obtain image data from the printer 200 or the terminal apparatus 300, to generate the conveying command or the partial printing command by using the image data, and to transmit the command to the printer 200. The server may be a plurality of calculators configured to perform communication each other via the network.

(13) In the respective illustrative embodiments as described above, some of the configuration performed by hardware may be replaced with software, and some or all of the configuration performed by software may be replaced with hardware. For example, some of the image processing shown in FIGS. 5A and 5B may be performed by a dedicated hardware circuit (for example, ASIC) configured to operate in response to an instruction from the CPU 210.

Although the present disclosure has been described with reference to the illustrative embodiments and the modified embodiments, the present disclosure may be provided so as to easily understand the present disclosure, not to limit the present disclosure. The present disclosure can be changed and improved without departing from the scope thereof, and the present disclosure may include equivalents thereof.

What is claimed is:

1. An image processing device for a printing execution device, the printing execution device comprising: a printing head having a plurality of nozzles configured to eject ink; an ink supplier configured to supply the ink to the printing head; and a first scanning device configured to execute a first scanning of moving a printing medium relative to the printing head in a first direction, the printing head being configured to form on the printing medium a plurality of types of dots comprising a first type of dot and a second type of dot, the second type of dot being larger than the first type of dot, the image processing device being configured to:

determine whether a specific condition is satisfied, the specific condition indicating that the ink supply from the ink supplier to the printing head may be delayed;

generate dot data by using image data, the dot data indicating a formation state of a dot for each pixel, the generating comprising:

in a case the specific condition is not satisfied, generating first dot data by executing first generation processing; and in a case the specific condition is satisfied, generating second dot data by executing second generation processing, a ratio of dots of the first type of dot included in an image based on specific second dot data generated by using specific image data being greater than a ratio of dots of the first type of dot included in an image based on specific first dot data generated by using the specific image data, a ratio of dots of the second type of dot included in the image based on the specific second dot data being smaller than a ratio of dots of the second type of dot included in the image based on the specific first dot data, and total number of dots included in the image based on the specific second dot data being larger than total number of dots included in the image based on the specific first dot data; and output, to the printing execution device, printing data based on the dot data.

2. The image processing device according to claim 1, wherein the first generation processing comprises first halftone processing comprising:

in a case a value of a notice pixel based on the image data indicates a density equal to or greater than a first threshold value, determining to form the second type of dot corresponding to the notice pixel; and in a case the value of the notice pixel indicates a density smaller than the first threshold value, determining not to form the second type of dot corresponding to the notice pixel, and wherein the second generation processing comprises second halftone processing comprising:

in a case the value of the notice pixel indicates a density equal to or greater than a second threshold value, determining to form the second type of dot corresponding to the notice pixel, the second threshold value being greater than the first threshold value; and in a case the value of the notice pixel indicates a density smaller than the second threshold value, determining not to form the second type of dot corresponding to the notice pixel.

3. The image processing device according to claim 2, wherein the plurality of nozzles of the printing head comprises:

two or more nozzles configured to eject the ink of a first color; and two or more nozzles configured to eject the ink of a second color that is different from the first color, wherein the printing head is configured to form on the printing medium the plurality of types of dots by using each of the ink of the first color and the ink of the second color, wherein the image processing device is configured to determine, for each of the ink of the first color and the ink of the second color, whether the specific condition is satisfied, and wherein the generating comprises:

in a case it is determined that the specific condition is not satisfied for the ink of the first color, generating the first dot data with respect to the ink of the first color;

in a case it is determined that the specific condition is satisfied for the ink of the first color, generating the second dot data with respect to the ink of the first color;

in a case it is determined that the specific condition is not satisfied for the ink of the second color, generating the first dot data with respect to the ink of the second color; and in a case it is determined that the specific condition is satisfied for the ink of the first color, generating the second dot data with respect to the ink of the second color.

4. The image processing device according to claim 1, wherein the image based on the first dot data is an image comprising dots of the first type of dot and dots of the second type of dot, and wherein the image based on the second dot data is an image comprising dots of the first type of dot without dots of the second type of dot.

5. The image processing device according to claim 3, wherein the plurality of nozzles of the printing head comprises:

two or more nozzles configured to eject the ink of a first color; and two or more nozzles configured to eject the ink of a second color that is different from the first color, wherein the printing head is configured to form on the printing medium the plurality of types of dots by using each of the ink of the first color and the ink of the second color, wherein the image processing device is configured to determine, for each of the ink of the first color and the ink of the second color, whether the specific condition is satisfied, and wherein the generating comprises:

in a case it is determined that the specific condition is not satisfied for the ink of the first color, generating the first dot data with respect to the ink of the first color;

in a case it is determined that the specific condition is satisfied for the ink of the first color, generating the second dot data with respect to the ink of the first color;

in a case it is determined that the specific condition is not satisfied for the ink of the second color, generating the first dot data with respect to the ink of the second color; and in a case it is determined that the specific condition is satisfied for the ink of the first color, generating the second dot data with respect to the ink of the second color.

6. The image processing device according to claim 1, wherein the first generation processing comprises first processing of generating the first dot data by using the image data, wherein the second generation processing comprises the first processing and second processing to be executed after the first processing, the second processing generating the second dot data by using the first dot data generated in the first processing, and wherein the image based on the second dot data is an image obtained by replacing N dots of the second type of dot in the image based on the first dot data with M dots of the first type of dot, where N is an integer of 1 or greater, and M is an integer greater than N.

7. The image processing device according to claim 6, wherein the determining comprises:

calculating an index value relating to a used amount of the ink to be used when printing an image based on the image data; and in a case it is determined that the used amount of the ink is equal to or greater than a reference value, determining that the specific condition is satisfied based on comparison of the index value and a threshold value, and wherein the generating comprises:

in a case of executing the second generation processing to generate the second dot data, determining a ratio of dot, which is to be replaced with the first type of dot, of the dots of the second type of dot in the image based on the first dot data, based on a difference between the index value and the threshold value;

in a case the difference between the index value and the threshold value is a first difference, determining a first ratio as the ratio of dot; and in a case the difference between the index value and the threshold value is a second difference greater than the first difference, determining a second ratio as the ratio of dot, the second ratio being greater than the first ratio.

8. The image processing device according to claim 6, wherein the plurality of nozzles of the printing head comprises:

two or more nozzles configured to eject the ink of a first color; and two or more nozzles configured to eject the ink of a second color different from the first color, wherein the printing head is configured to form on the printing medium the plurality of types of dots by using each of the ink of the first color and the ink of the second color, wherein the image processing device is configured to determine, for each of the ink of the first color and the ink of the second color, whether the specific condition is satisfied, and wherein the generating comprises:

in a case it is determined that the specific condition is not satisfied for both the ink of the first color and the ink of the second color, generating the first dot data with respect to both the ink of the first color and the ink of the second color, and in a case it is determined that the specific condition is satisfied for at least one of the ink of the first color and the ink of the second color, generating the second dot data with respect to both the ink of the first color and the ink of the second color.

9. The image processing device according to claim 1, wherein the printing execution device further comprises:

a second scanning device configured to execute a second scanning of moving the printing head relative to the printing medium in a second direction intersecting with the first direction, wherein the printing execution device is configured to perform printing by executing partial printing and the first scanning for a plurality of times, the partial printing comprises controlling the printing head to eject the ink while executing the second scanning by the second scanning device, wherein the image data is partial image data corresponding to the single partial printing, wherein the determining comprises determining, in each partial printing, whether the specific condition is satisfied, and wherein the generating comprises generating, in each partial printing, the dot data by using the partial image data.

10. A printing apparatus comprising:

a printing execution device comprising:

a printing head having a plurality of nozzles configured to eject ink;

an ink supplier configured to supply the ink to the printing head; and a first scanning device configured to execute a first scanning of moving a printing medium relative to the printing head in a first direction, the printing head being configured to form on the printing medium a plurality of types of dots comprising a first type of dot and a second type of dot, the second type of dot being larger than the first type of dot; and the image processing device according to claim 1.

11. A non-transitory computer-readable medium storing a computer program readable by a computer of a printing execution device, the printing execution device comprising: a printing head having a plurality of nozzles configured to eject ink; an ink supplier configured to supply the ink to the printing head; and a first scanning device configured to execute a first scanning of moving a printing medium relative to the printing head in a first direction, the printing head configured to form on the printing medium a plurality of types of dots comprising a first type of dot and a second type of dot, the second type of dot being larger than the first type of dot, the computer program, when executed by the computer, causing the printing execution device to perform:

determining whether a specific condition is satisfied, the specific condition indicating that the ink supply from the ink supplier to the printing head may be delayed;

generating dot data by using image data, the dot data indicating a formation state of a dot for each pixel, the generating comprising:

in a case the specific condition is not satisfied, generating first dot data by executing first generation processing; and in a case the specific condition is satisfied, generating second dot data by executing second generation processing, a ratio of dots of the first type of dot included in an image based on specific second dot data generated using specific image data being greater than a ratio of dots of the first type of dot included in an image based on specific first dot data generated using the specific image data, a ratio of dots of the second type of dot included in the image based on the specific second dot data being smaller than a ratio of dots of the second type of dot included in the image based on the specific first dot data, and total number of dots included in the image based on the specific second dot data being larger than a total number of dots included in the image based on the specific first dot data; and outputting, to the printing execution device, printing data based on the dot data.

* * * * *